US008065030B2

(12) United States Patent
Yamada

(10) Patent No.: US 8,065,030 B2
(45) Date of Patent: Nov. 22, 2011

(54) EMBROIDERY DATA GENERATING DEVICE AND COMPUTER-READABLE MEDIUM STORING EMBROIDERY DATA GENERATING PROGRAM

(75) Inventor: Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 222 days.

(21) Appl. No.: 12/591,051

(22) Filed: Nov. 5, 2009

(65) Prior Publication Data

US 2010/0145494 A1 Jun. 10, 2010

(30) Foreign Application Priority Data

Dec. 5, 2008 (JP) ..... 2008-311609

(51) Int. Cl.
*D05C 5/02* (2006.01)

(52) U.S. Cl. ..... 700/138

(58) Field of Classification Search ..... 700/136–138; 112/470.01, 470.04, 470.06, 475.18, 475.19, 112/453
See application file for complete search history.

(56) References Cited

U.S. PATENT DOCUMENTS 5,343,401 A * 8/1994 Goldberg et al. ..... 700/138
6,629,015 B2 9/2003 Yamada
6,836,695 B1 * 12/2004 Goldman ..... 700/138
7,680,558 B2 * 3/2010 Yamada ..... 700/138
2002/0038162 A1 * 3/2002 Yamada ..... 700/138
2007/0162177 A1 7/2007 Yamada

FOREIGN PATENT DOCUMENTS

JP A-11-114260 4/1999
JP A-2001-259268 9/2001
JP A-2003-154181 5/2003
JP A-2007-175087 7/2007

* cited by examiner

*Primary Examiner* — Nathan Durham
(74) *Attorney, Agent, or Firm* — Oliff & Berridge, PLC

(57) ABSTRACT

An embroidery data generating device includes a line segment data generation device that generates a plurality of line segment data pieces based on image data, a distance calculation device that calculates a distance from an ending endpoint of one of a plurality of line segments to an endpoint of another of the plurality of line segments, an angle calculation device that calculates an angle formed by the one of the plurality of line segments and the other of the plurality of line segments, a connecting endpoint determination device that determines which of endpoints of the plurality of line segments is a connecting endpoint to be connected to the ending endpoint, a line segment connecting device that connects the plurality of line segments by connecting the ending endpoint and the connecting endpoint, and an embroidery data generation device that generates embroidery data for forming stitches following the plurality of line segments.

20 Claims, 21 Drawing Sheets

EMBROIDERY DATA GENERATING DEVICE AND COMPUTER-READABLE MEDIUM STORING EMBROIDERY DATA GENERATING PROGRAM

CROSS REFERENCE TO RELATED APPLICATION

This application claims priority to Japanese Patent Application No. 2008-311609, filed Dec. 5, 2008, the content of which is hereby incorporated herein by reference in its entirety.

BACKGROUND

The present disclosure relates to an embroidery data generating device and a computer-readable medium that stores an embroidery data generating program that generate embroidery data that is used by an embroidery sewing machine to produce an embroidered pattern based on a photographic image or the like.

An embroidery data generating device is known that automatically generates embroidery data based on a photographic image or the like in which grayscale values, colors, and the like vary continuously in two dimensions. More specifically, based on image data of a photographic image or the like, line segment information that has angles is first generated from an image that is inputted. Next, thread color information for each of the line segments is set in accordance with color information in the inputted image. Then, for each of the thread colors, distances between the endpoints of each of the line segments are calculated. The embroidery data that is suitable for use by the embroidery sewing machine is generated by sequentially connecting an endpoint of a line segment to the closest endpoint of another line segment.

The number of line segments that are generated based on the data for an image ranges from several thousand to several tens of thousands. Accordingly, an embroidery data generating device is known that is capable of shortening the time that is required to calculate connection of the line segments. Specifically, a sequential search is performed for the line segments within a block, in accordance with a search order that is determined based on a search hierarchy table, until a specified search range is exceeded. A distance between an ending endpoint of a current line segment and an endpoint of a line segment that is newly found by the line segment search is compared to a distance between the ending endpoint of the current line segment and an endpoint of a line segment that was previously found. The line segment for which the distance is shorter is outputted as the next line segment. By eliminating the need to perform calculations for all of the line segments that are generated based on the data for the image, the time that is required to calculate the connection of the line segments may be shortened.

SUMMARY

When the line segments are connected in order simply on the basis of the shortest distance between the endpoints, as is done by the embroidery data generating device that is described above, it may happen that the line segments are connected in such a way that the line segments form a sharp bend or abruptly reverse direction, for example. In a case where the embroidery sewing machine performs embroidering based on this sort of embroidery data, a sharp bend or an abrupt reversal of direction may occur in stitches of an embroidered pattern, causing the stitches of the embroidered pattern to look unnatural.

Various exemplary embodiments of the broad principles derived herein provide an embroidery data generating device and a computer-readable medium that stores an embroidery data generating program that are capable of generating embroidery data by which the embroidered pattern is produced by natural stitches.

Exemplary embodiments provide an embroidery data generating device that includes a line segment data generation device that generates a plurality of line segment data pieces based on image data being an aggregation of pixels, each of the plurality of line segment data pieces including an angle component, a distance calculation device that calculates a distance from an ending endpoint of one of a plurality of line segments to an endpoint of another of the plurality of line segments, the plurality of line segments being respectively specified by the plurality of line segment data pieces generated by the line segment data generation device, and an angle calculation device that calculates an angle formed by the one of the plurality of line segments and the other of the plurality of line segments. The embroidery data generating device also includes a connecting endpoint determination device that, based on a result of a calculation by the distance calculation device and a result of a calculation by the angle calculation device, determines which of endpoints of the plurality of line segments is a connecting endpoint to be connected to the ending endpoint, a line segment connecting device that connects the plurality of line segments by connecting the ending endpoint and the connecting endpoint, and an embroidery data generation device that generates embroidery data for forming stitches following the plurality of line segments connected by the line segment connecting device.

Exemplary embodiments also provide a computer-readable medium storing an embroidery data generating program. The program includes instructions that cause a computer to perform the steps of generating a plurality of line segment data pieces based on image data being an aggregation of pixels, each of the line segment data pieces including an angle component, calculating a distance from an ending endpoint of one of a plurality of line segments to an endpoint of another of the plurality of line segments, the plurality of line segments being respectively specified by the plurality of line segment data pieces, and calculating an angle formed by the one of the plurality of line segments and the other of the plurality of line segments. The program also includes instructions that cause the computer to perform the steps of determining, based on a result of a distance calculation and a result of an angle calculation, which of endpoints of the plurality of line segments is a connecting endpoint to be connected to the ending endpoint, connecting the plurality of line segments by connecting the ending endpoint and the connecting endpoint, and generating embroidery data for forming stitches following the plurality of line segments that have been connected.

BRIEF DESCRIPTION OF THE DRAWINGS

Exemplary embodiments will be described below in detail with reference to the accompanying drawings in which.

DETAILED DESCRIPTION

Figure 1:
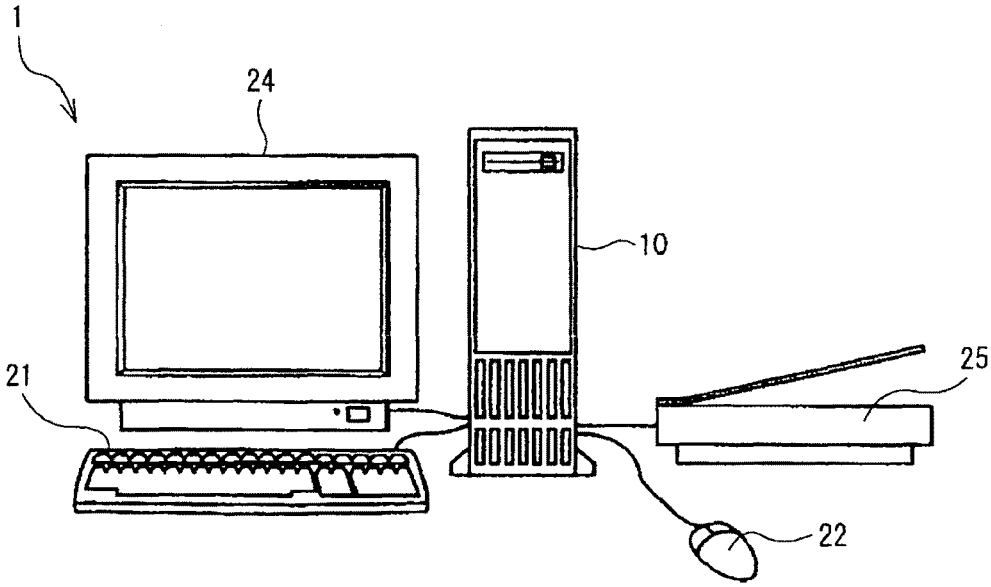
FIG. 1 is an overall configuration diagram that shows a physical configuration of an embroidery data generating device.

Hereinafter, an embroidery data generating device 1 according to a first embodiment will be explained with reference to FIGS. 1 to 8. Configurations of the embroidery data generating device 1 will be explained with reference to FIGS. 1 and 2. In the embroidery data generating device 1, embroidery data is generated based on image data. The embroidery data are used by an embroidery sewing machine 3 that will be described below to produce an image of a photograph, an illustration, or the like in the form of an embroidered pattern. As shown in FIG. 1, a physical configuration of the embroidery data generating device 1 is the same as that of a personal computer. A keyboard 21, a mouse 22, a display 24, and an image scanner 25 are connected to a main body 10.

Figure 2:
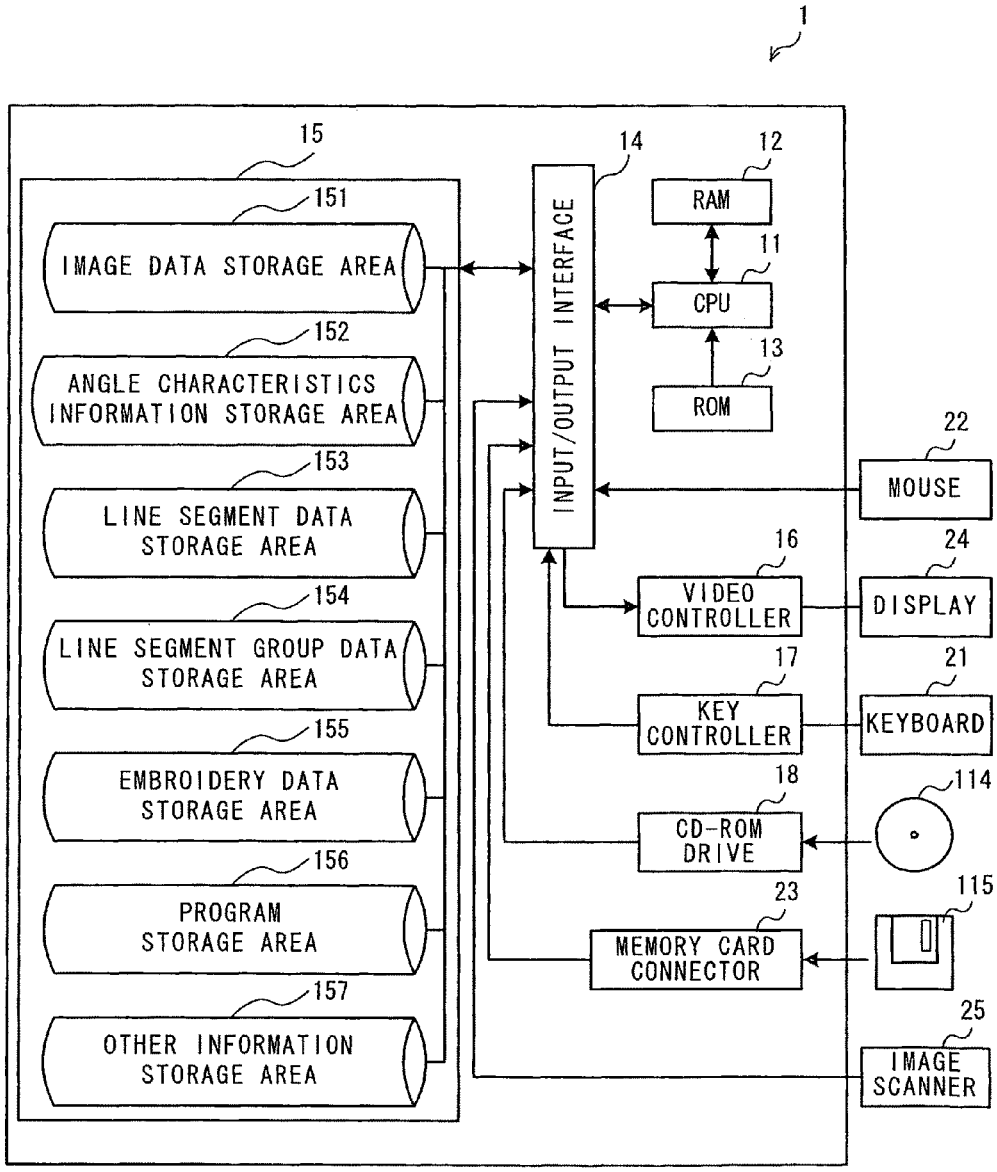
FIG. 2 is a block diagram that shows a functional configuration of the embroidery data generating device.

An electrical configuration of the embroidery data generating device 1 will be explained. As shown in FIG. 2, a CPU 11 is provided in the embroidery data generating device 1 that performs control of the embroidery data generating device 1 as a controller. A RAM 12, a ROM 13, and an input/output interface 14 are connected to the CPU 11. The RAM 12 temporarily stores various types of data. The ROM 13 stores a BIOS and the like. The input/output interface 14 mediates exchanges of data. A hard disk drive 15 is connected to the input/output interface 14. The hard disk drive 15 includes at least an image data storage area 151, an angle characteristics information storage area 152, a line segment data storage area 153, a line segment group data storage area 154, an embroidery data storage area 155, a program storage area 156, and an other information storage area 157.

Image data that is read by the image scanner 25 is stored in the image data storage area 151. The image data that is stored in the image data storage area 151 may be image data for an image that was captured by a digital camera and may also be image data of an image that was generated by drawing software. In a case where the embroidery data generating device 1 can be connected to a network, image data that is stored in another personal computer may also be acquired. Image data that is stored in one of a CD-ROM 114 and a memory card 115 may also be stored in the image data storage area 151. In a case where data that is stored in another storage medium can be read, image data that is stored in the storage medium may also be acquired.

Angle characteristics information for each of pixels that constitute the image data is stored in the angle characteristics information storage area 152. As will be described below, the angle characteristics information includes an angle characteristic and an angle characteristic intensity. Line segment data is stored in the line segment data storage area 153. The line segment data is generated based on the angle characteristics information and indicates each of the stitches that form an embroidery pattern in the form of a line segment. Various types of line segment group data that will be described below and in which a plurality of the line segment data pieces for line segments are connected is stored in the line segment group data storage area 154. Embroidery data that is generated by an embroidery data generating program that is executed by the CPU 11 is stored in the embroidery data storage area 155. The embroidery data is used when embroidering is performed by the embroidery sewing machine 3. The embroidery data includes information that indicates a color code, an embroidering position, and an embroidering size, as well as stitch data that indicates stitches for producing the embroidery. At least the embroidery data generating program according to the present disclosure is stored in the program storage area 156. A thread color correspondence table that will be described below and other information that is used by the embroidery data generating device 1 are stored in the other information storage area 157. In a case where the embroidery data generating device 1 is a dedicated device that is not provided with the hard disk drive 15, the embroidery data generating program may be stored in the ROM 13.

The mouse 22, a video controller 16, a key controller 17, a CD-ROM drive 18, a memory card connector 23, and the image scanner 25 are connected to the input/output interface 14. The display 24 is connected to the video controller 16, and the keyboard 21 is connected to the key controller 17. The embroidery data generating program that is a control program for the embroidery data generating device 1 may be stored in the CD-ROM 114, which is inserted into the CD-ROM drive 18. When the embroidery data generating program is installed, the embroidery data generating program is set up in the hard disk drive 15 from the CD-ROM 114 and is stored in the program storage area 156. The memory card connector 23 may be used to read from and write to the memory card 115.

Figure 3:
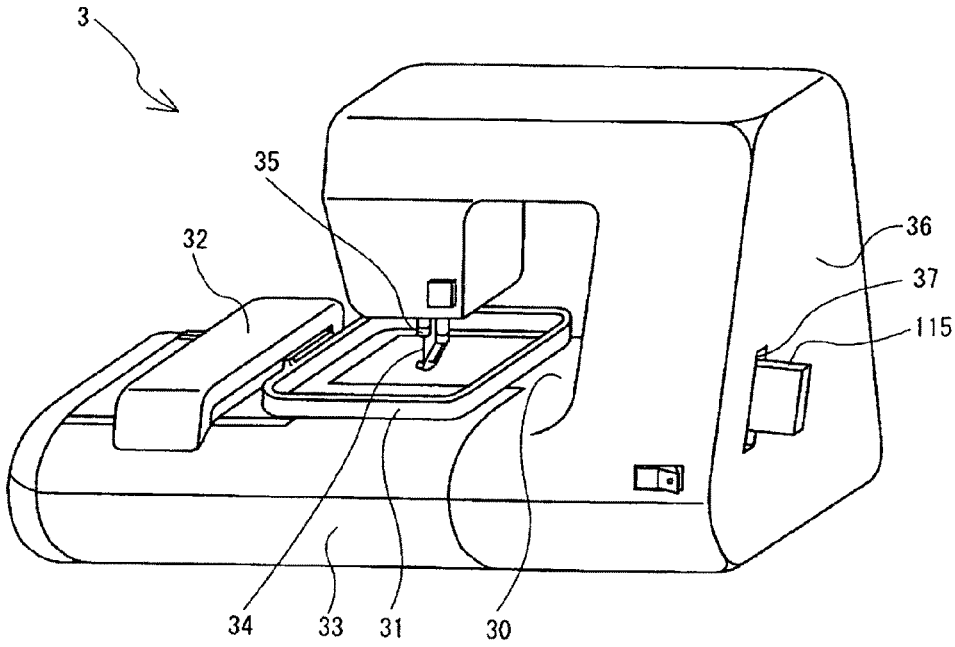
FIG. 3 is an external view of an embroidery sewing machine.

A configuration of the embroidery sewing machine 3 will be explained with reference to FIG. 3. As shown in FIG. 3, the embroidery sewing machine 3 is provided with a bed 30 and an embroidery frame 31. The embroidery frame 31 is disposed on the bed 30 and holds a work cloth on which embroidery will be performed. A needle bar 35, in which a needle 34 is mounted, and a shuttle mechanism (not shown in the drawings) are driven while a Y direction drive portion 32 and an X direction drive mechanism (not shown in the drawings) move the embroidery frame 31 to a position that is indicated by an XY coordinate system that is specific to the embroidery sewing machine 3. In this manner, the stitching is performed on the work cloth that is held by the embroidery frame 31. The X direction drive mechanism is accommodated within a main body case 33. The Y direction drive portion 32, the X direction drive mechanism, and the needle bar 35 and the like are controlled by a control unit (not shown in the drawings) that is configured from a microcomputer or the like that is built into the embroidery sewing machine 3.

A memory card slot 37 is provided on a side face of a pillar 36 of the embroidery sewing machine 3. The memory card 115 may be inserted into and removed from the memory card slot 37. The embroidery data is supplied to the embroidery sewing machine 3 by inserting the memory card 115 in which the embroidery data is stored into the memory card slot 37. The control unit (not shown in the drawings) of the embroidery sewing machine 3 automatically performs the embroidery operation described above based on the embroidery data that is supplied from the memory card 115.

Processing by which the embroidery data generating device 1 according to the first embodiment generates the embroidery data from the image data will be explained with reference to FIG. 4. Main processing that is shown in FIG. 4 is performed by the CPU 11 of the embroidery data generating device 1 based on the embroidery data generating program.

Figure 4:
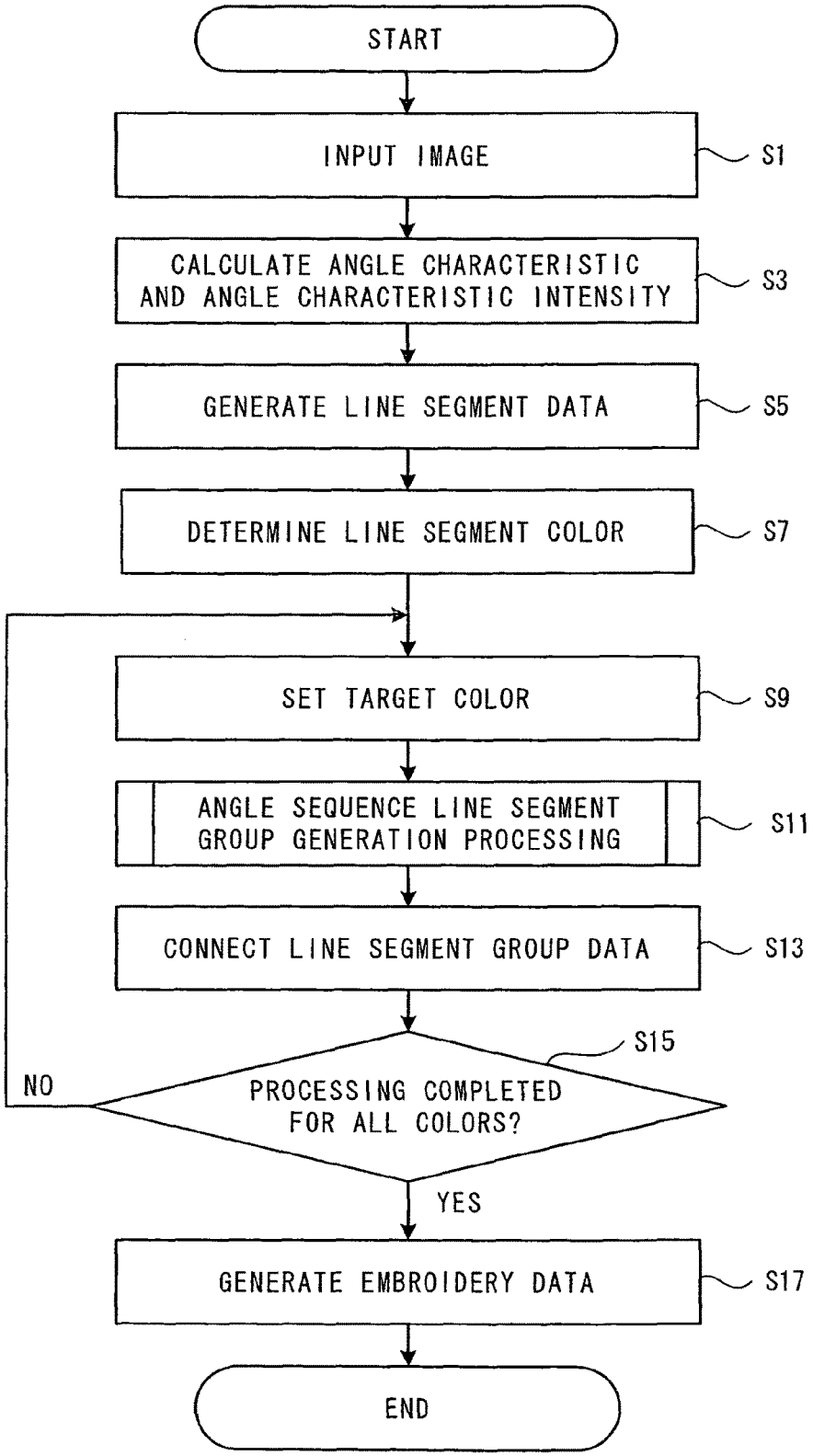
FIG. 4 is a flowchart that shows main processing in an embroidery data generating device according to a first embodiment.

As shown in FIG. 4, the CPU 11 first performs input of the image data for generating the embroidery data (Step S1). Specifically, when an image is acquired by the image scanner 25 or when a file that is stored in an external storage medium such as a memory card is designated, the CPU 11 stores the image data that corresponds to the image or the file in the image data storage area 151. The image data is configured from a plurality of pixels. Color information for each of the pixels indicates an RGB value, for example. The color information for each of the pixels may also indicate a hue, an intensity, and a saturation. The image is formed by arranging the pixels in the form of a matrix.

Next, the CPU 11 computes the angle characteristic and the angle characteristic intensity for each of the pixels from which the image data that are stored in the image data storage area 151 are configured (Step S3). The angle characteristic indicates a direction of a change in the brightness of the pixel. The angle characteristic intensity indicates a magnitude of the change in the brightness of the pixel. Any one of various known techniques may be used as the method for computing the angle characteristic and the angle characteristic intensity, so a detailed explanation of the method will be omitted. For example, Japanese Laid-Open Patent Publication No. 2001-259268 discloses a method for computing the angle characteristic and the angle characteristic intensity, the relevant portions of which are herein incorporated by reference. The CPU 11 stores the angle characteristic and the angle characteristic intensity that were computed at Step S3 as the angle characteristics information in the angle characteristics information storage area 152.

Next, the CPU 11 generates the line segment data based on the angle characteristics information that is stored in the angle characteristics information storage area 152 (Step S5). The line segments that are specified by the line segment data that is generated at Step S5 ultimately become the stitches in the embroidery data. The line segment data that is ultimately generated includes an angle component, a length component, and a color component for each of the pixels. The line segment data that is generated at Step S5 includes the angle component and the length component. More specifically, CPU 11 sets the angle characteristic that is computed at Step S3 as the angle component in the line segment data. For the length component in the line segment data, the CPU 11 sets one of a fixed value that is set in advance and an input value that a user inputs. The line segment data is thus generated such that a line segment that has the angle component and the length component that have been set is disposed with a target pixel at its midpoint. The CPU 11 stores the line segment data that is generated at Step S5 in the line segment data storage area 153. The CPU 11 also takes the line segment data that is stored in the line segment data storage area 153 and, based on corresponding positions in the image data, arranges pieces of the line segment data in a work area of the RAM 12, for example. The work area in which the line segment data pieces are arranged may also be provided in another storage medium such as the hard disk drive 15.

Once the line segment data has been generated for all of the pixels that make up the image, when the embroidering is performed according to the embroidery data that is generated based on the line segment data, the quality of the embroidery may be impaired. For example, there may be far too many stitches, and the same location may be sewn over and over again. If the line segment data is generated in a uniform way for the pixels for which the angle characteristic intensity is low, the embroidery data that is generated may not effectively reflect the characteristics of the image as a whole. Accordingly, the CPU 11 scans all of the pixels that make up the image in order from left to right and from top to bottom, then generates and arranges the line segment data only for the pixels whose angle characteristic intensities are greater than a specified threshold value (refer to Japanese Laid-Open Patent Publication No. 2001-259268, for example). One of a fixed value that is set in advance and an input value that is inputted by the user may be set as the threshold value for the angle characteristic intensity.

Next, the CPU 11 determines the color component for each of line segment data pieces based on the image data and the line segment data (Step S7). Any one of various known techniques may be used as the method for determining the color component for the line segment data. For example, the CPU 11 may generate the thread color correspondence table in advance, based on the number of embroidery thread colors to be used, thread color information (for example, RGB values) for as many embroidery threads as there are colors, and color codes that are inputted. The CPU 11 then refers to the thread color correspondence table, and sets a thread color that most closely approximates a color of a line segment that is specified by the line segment data piece (in other words, a color in the image data) as the color component in the line segment data piece (for details, refer to Japanese Laid-Open Patent Publication No. 2001-259268, for example). A plurality of line segment data pieces are thus stored in the line segment data storage area 153. Each of the line segment data pieces corresponds to one of the pixels that make up the image and includes the angle component, the length component, and the color component. The colors for the line segment data pieces that are arranged in the RAM 12 are set based on the color components that are determined at Step S7.

Next, in order to perform subsequent processing (Steps S9 to S15) for each of the thread colors that are stored in the thread color correspondence table, the CPU 11 sets the thread color for which the processing is to be performed (Step S9). The thread color for which the processing is to be performed is hereinafter referred to as the "target color." The CPU 11 then performs angle sequence line segment group generation processing that generates angle sequence line segment group data for the current target color that was set at Step S9 (Step S11). The angle sequence line segment group data is data that specify a line segment group in which the endpoints of the respective line segments that are specified by the line segment data pieces are close to one another and the line segments in which an angular difference is in a specified range are connected in a continuous series.

Figure 5:
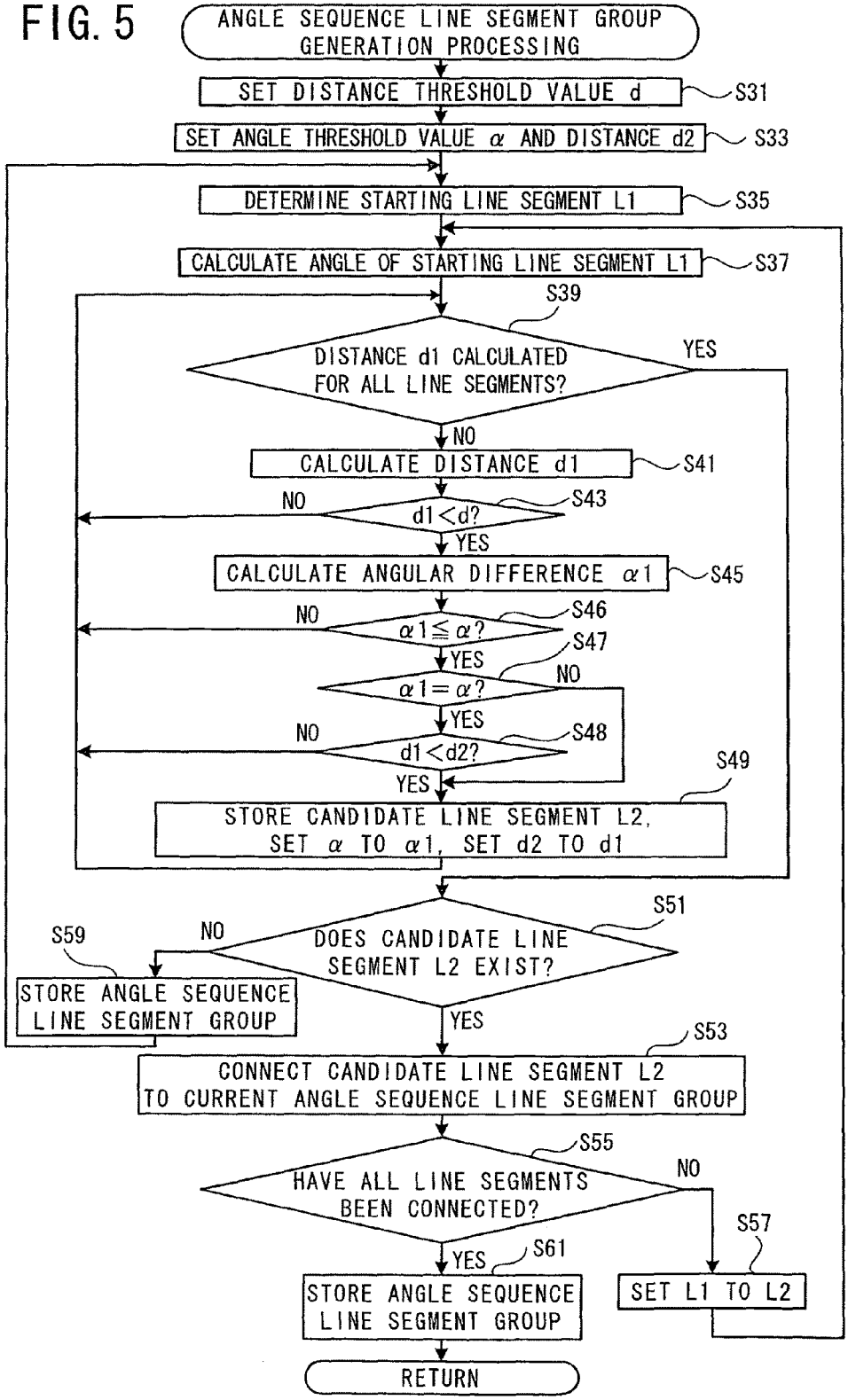
FIG. 5 is a flowchart that shows details of angle sequence line segment group generation processing.

Details of the angle sequence line segment group generation processing will be explained with reference to FIG. 5. As shown in FIG. 5, in the angle sequence line segment group generation processing, the CPU 11 first sets a distance threshold value d (Step S31). The distance threshold value d is a threshold value for selecting a line segment data piece that will become eligible for connection to another line segment data piece, based on a distance between the endpoints of the line segments that are specified by the two line segment data pieces. The line segment data piece that will become eligible for connection to another line segment data piece is hereinafter referred to as the "connection target line segment data piece." Specifically, the distance threshold value d may be a value that is derived by dividing the length of a stitch (for example, three millimeters) by a positive integer (for example, 3).

The CPU 11 also sets an angle threshold value $\alpha$ and sets the distance threshold value d as an initial value for a distance d2 (Step S33). The angle threshold value $\alpha$ is a threshold value for selecting a connection target line segment data piece, based on the difference between the angles of the line segments that are specified by the two line segment data pieces. Specifically, the angle threshold value $\alpha$ may be a maximum angular difference (for example, 45 degrees) between two stitches that will be connected such that the embroidered pattern will appear natural. In a case where the angular differences are equal among a plurality of connection target line segment data pieces, the distance d2 is a value for selecting a connection target line segment data piece, based on the distances between the endpoints of the line segments that are specified by the plurality of connection target line segment data pieces.

At Step S31, the CPU 11 may also set the distance threshold value d by reading out a pre-set value that has been stored in advance in the ROM 13 or the like. The CPU 11 may also set a value that has been discretionally inputted by the user or the like as the distance threshold value d. In the same manner, at Step S33, the CPU 11 may also set one of a pre-set value that has been stored in advance in the ROM 13 or the like and a value that has been discretionally inputted as the angle threshold value $\alpha$.

The CPU 11 performs the processing described below for each of line segment data pieces that correspond to the current target color. The CPU 11 first determines a starting line segment L1, as well as a starting endpoint and an ending endpoint of the starting line segment L1 (Step S35). The starting line segment L1 corresponds to a line segment data piece for which the processing is to be performed. The starting line segment L1 may correspond to any line segment data piece. Either one of the endpoints of the starting line segment L1 may be designated to serve as the starting endpoint, with the other endpoint serving as the ending endpoint. In the present embodiment, for the plurality of line segment data pieces that are stored in the line segment data storage area 153, the CPU 11 scans the line segment data pieces that are arranged in the RAM 12 from left to right and from top to bottom. The CPU 11 takes a line segment data piece that has an endpoint that is located farthest to the upper left of the work area in the RAM 12 and designates the line segment data piece as a line segment data piece that corresponds to the starting line segment L1. The endpoint that is located farthest to the upper left is designated as the starting endpoint, and the other endpoint is designated as the ending endpoint of the starting line segment L1.

The CPU 11 calculates an angle $\theta$ of the current starting line segment L1 that was determined at Step S35 (Step S37). For example, an arctangent may be calculated based on a coordinate position ($\times 0$, y0) of the starting endpoint of the starting line segment L1 and a coordinate position ($\times 1$, y1) of the ending endpoint, and the angle $\theta$ may be determined according to a quadrant in which the ending endpoint is located in relation to the starting endpoint (refer to FIG. 6). The CPU 11 may not need to calculate the angle $\theta$ every time the processing at Step S37 is performed. Instead of calculating the angle $\theta$, the CPU 11 may acquire the angle characteristic that is stored in advance in the angle characteristics information storage area 152 for a line segment data piece and use the angle characteristic as the angle $\theta$. In this case, the value of the angle $\theta$ differs by 180 degrees depending on which endpoint of the line segment that is specified by the line segment data piece is the starting endpoint and which is the ending endpoint.

The CPU 11 determines whether a distance d1 has been calculated at Step S41, which is described below, for all line segment data pieces, other than the current starting line segment L1, that correspond to the current target color (Step S39). If a line segment data piece exists for which the distance d1 has not been calculated (NO at Step S39), it means that an unprocessed line segment data piece (that is, an unprocessed candidate line segment) exists. The candidate line segment is specified by a line segment data piece that is a candidate for connection to the current starting line segment L1. The CPU 11 sequentially sets all the line segment data pieces as candidate line segments, except a line segment data piece for the current starting line segment L1. The CPU 11 performs the processing that is described below until there are no more unprocessed candidate line segments (YES at Step S39).

First, the CPU 11 calculates the distance d1 between the ending endpoint of the current starting line segment L1 and an endpoint of a candidate line segment (Step S41). The distance d1 may be calculated based on the coordinate position ($\times 1$, y1) of the ending endpoint of the current starting line segment L1 and the coordinate position of the endpoint of the candidate line segment. Because a line segment that is specified by a line segment data piece has two endpoints, the CPU 11 calculates the distances from the ending endpoint of the starting line segment L1 to both of the endpoints of the candidate line segment, then determines that the shorter of the two distances is the distance d1. The CPU 11 then determines whether the distance d1 that has been calculated at Step S41 is less than the distance threshold value d (for example, one millimeter) that was set at Step S31 (Step S43).

If the distance d1 is less than the distance threshold value d (YES at Step S43), the CPU 11 calculates an angular difference $\alpha 1$ between the angle $\theta$ of the current starting line segment L1 and the angle of the current candidate line segment (Step S45). The angular difference $\alpha 1$ is obtained by calculating the angle of the candidate line segment in the same manner as at Step S37, then determining the difference between the angle of the candidate line segment and the angle θ of the current starting line segment L1 that was calculated at Step S37. In this case, the CPU 11 calculates the angle of the candidate line segment by defining the candidate line segment endpoint that is closer to the current starting line segment L1 as the starting endpoint and defining the endpoint that is farther away as the ending endpoint. The CPU 11 may not need to calculate the angle of the candidate line segment every time that the Step S45 is performed, in the same manner as at Step S37. Instead of calculating the angle of the candidate line segment, the CPU 11 may acquire the angle characteristic in the line segment data piece that is stored in the line segment data storage area 153 and use the angle characteristic as the angle of the candidate line segment. The CPU 11 then determines whether the angular difference α1 that was calculated at Step S45 is equal to or less than the angle threshold value α (for example, 45 degrees) that was set at Step S33 (Step S46).

If the angular difference α1 is equal to or less than the angle threshold value α (YES at Step S46), the CPU 11 determines whether the angular difference α1 is equal to the angle threshold value α(Step S47). If the angular difference α1 is equal to the angle threshold value α (YES at Step S47), the CPU 11 determines whether the current distance d1 that was calculated at Step S41 is less than the distance d2 (Step S48). In a case where the angular difference α1 is not equal to the angle threshold value α (NO at Step S47) or in a case where the distance d1 is less than the distance d2 (YES at Step S48), the CPU 11 stores the line segment data piece for the current candidate line segment in a specified area of the RAM 12 as a candidate line segment L2 that is eligible for connection to the current starting line segment L1 (Step S49). The CPU 11 also changes the angle threshold value α that was set at Step S33 to the current angular difference α1 that was calculated at Step S45 (Step S49). The CPU 11 also changes the distance d2 to the current distance d1 that was calculated at Step S41 (Step S49).

In a case where the distance d1 is not less than the distance threshold value d (NO at Step S43), in a case where the angular difference α1 is neither equal to nor less than the angle threshold value α (NO at Step S46), or in a case where the distance d1 is not less than the distance d2 (NO at Step S48), the CPU 11 determines that the current candidate line segment is not eligible for connection to the current starting line segment L1 and returns to Step S39. In this case, the CPU 11 does not store the current candidate line segment as the candidate line segment L2. The CPU 11 then repeatedly performs the processing at Steps S41 to S49 for the next candidate line segment until there are no more unprocessed line segment data pieces for which the calculations at Step S41 have not been performed (YES at Step S39). At Step S49, the CPU 11 replaces the candidate line segment L2 that was previously stored in the specified area of the RAM 12 with the current candidate line segment L2.

When the processing at Steps S39 to S49 have been repeatedly performed for all of the line segment data pieces that correspond to the current target color, a line segment data piece, among the line segment data pieces, for which the distance d1 from the ending endpoint of the starting line segment L1 is less than the distance threshold value d that was set at Step S31 and for which the angular difference α1 from the angle θ of the starting line segment L1 is the smallest is stored as the candidate line segment L2. In a case where there is a plurality of line segment data pieces for which the angular difference α1 is the smallest, a line segment data piece for which the distance d1 is the shortest is stored as the candidate line segment L2. Thus, in a case where a plurality of line segment data pieces exist in which the angular differences α1 are equal and any one of which may be connected to the starting line segment L1, it is possible to connect the starting line segment L1 to the candidate line segment L2 for which the distance between the stitches will be the smallest when the embroidering is performed by the embroidery sewing machine 3.

Figure 6:
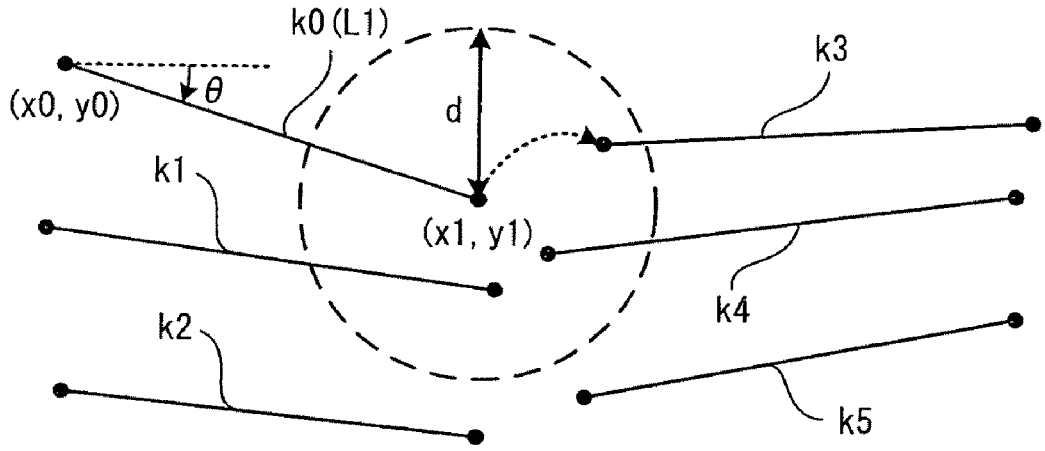
FIG. 6 is a figure for explaining a mode of connecting line segment data.

For example, a case is considered in which six line segment data pieces k0 to k5 that correspond to the target color are arranged in the RAM 12, and the line segment data piece k0 is the current starting line segment L1, as shown in FIG. 6. In this case, the candidate line segments for which the distance d1 from the line segment data piece k0 is within the range of the distance threshold value d that was set at Step S31 are the line segment data pieces k1, k3, and k4. Further, the candidate line segments for which the angular difference α1 from the line segment data piece k0 is within the range of the angle threshold value α that was set at Step S33 are the line segment data pieces k3 and k4. Finally, of the line segment data pieces k3 and k4 that may become eligible for connection to the line segment data piece k0, the line segment data piece k3, for which the angular difference α1 is smaller, is stored as the candidate line segment L2. In a case where a plurality of candidate line segments exist that may be connected to the starting line segment L1, this procedure makes it possible to connect the starting line segment L1 to the candidate line segment L2 for which the curvature from one stitch to the next will be the smallest when the embroidering is performed by the embroidery sewing machine 3.

When the calculations have been performed for all of the line segment data pieces, other than the current starting line segment L1, that correspond to the current target color (YES at Step S39), then no more unprocessed candidate line segments exist. The CPU 11 then determines whether the candidate line segment L2 exists (Step S51). If the candidate line segment L2 is stored in the RAM 12, the CPU 11 determines that the candidate line segment L2 does exist (YES at Step S51). The CPU 11 then connects the candidate line segment L2 to the current angle sequence line segment group data piece (Step S53). That is, by connecting the ending endpoint of the current starting line segment L1 and the endpoint (specifically, the starting endpoint) of the candidate line segment L2, the CPU 11 adds the candidate line segment L2 to the current angle sequence line segment group data piece in which the current starting line segment L1 is the last line segment.

Next, the CPU 11 determines whether all of the line segment data pieces that correspond to the current target color have been connected to the angle sequence line segment group data piece (Step S55). If a line segment data piece exists that has not been connected to the angle sequence line segment group data piece (NO at Step S55), the CPU 11 sets the candidate line segment L2 as the starting line segment L1, resets the angle threshold value α to the value that was set at Step S33, and resets the distance d2 to the distance threshold value d that was set at Step S31 (Step S57). The CPU 11 then returns to Step S37. Thereafter, the CPU 11 performs Steps S37 to S55 for the current starting line segment L1 that was set at Step S57. Then, if the candidate line segment L2 does exist for the current starting line segment L1 that was set at Step S57 (YES at Step S51), the CPU 11 connects the candidate line segment L2 to the current angle sequence line segment group data piece (Step S53).

If the candidate line segment L2 does not exist for the current starting line segment L1 (NO at Step S51), no other line segment data piece exists that may be connected to the current angle sequence line segment group data piece in which the current starting line segment L1 is the last line segment. Therefore, the CPU 11 stores the current angle sequence line segment group data piece in the line segment group data storage area 154, resets the angle threshold value α to the value that was set at Step S33, and resets the distance d2 to the distance threshold value d that was set at Step S31 (Step S59). The CPU 11 then returns to Step S35 and repeats the processing that is described above (Steps S35 to S59) to generate a new angle sequence line segment group data piece that starts with another unprocessed line segment data piece (that is, the next starting line segment L1).

If all of the line segment data pieces that correspond to the current target color have been connected to the angle sequence line segment group data piece (YES at Step S55), no other line segment data piece exists that may be connected to the current angle sequence line segment group data piece in which the current starting line segment L1 is the last line segment. Therefore, the CPU 11 stores the current angle sequence line segment group data piece in the line segment group data storage area 154 (Step S61). The CPU 11 then ends the angle sequence line segment group generation processing that is shown in FIG. 5 and returns to the main processing (FIG. 4). The processing that is described above causes at least one angle sequence line segment group data piece that corresponds to the current target color to be stored in the line segment group data storage area 154.

Figure 7:
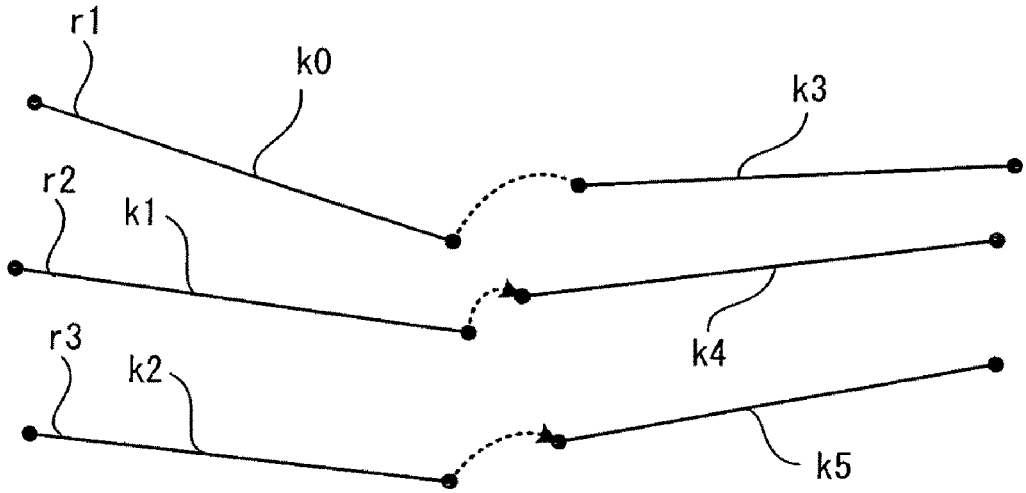
FIG. 7 is a figure for explaining a mode of connecting line segment data.
Figure 8:
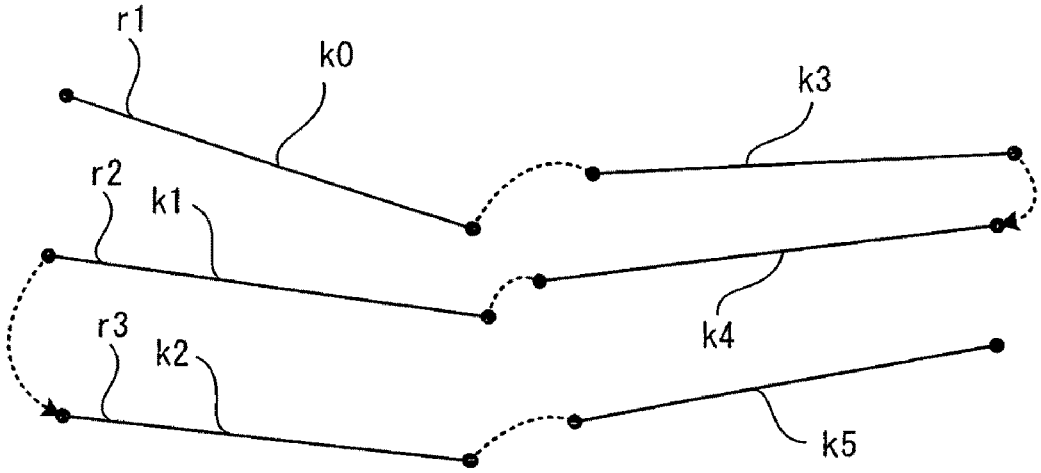
FIG. 8 is a figure for explaining a mode of connecting angle sequence line segment group data.

For example, assume that the processing that is described above is repeatedly performed using each of the line segment data pieces k0 to k5 that are shown in FIG. 6 as the current starting line segment L1. As shown in FIG. 7, three of the angle sequence line segment group data pieces are generated, specifically, an angle sequence line segment group data piece r1 in which the line segment data pieces k0 and k3 are connected, an angle sequence line segment group data piece r2 in which the line segment data pieces k1 and k4 are connected, and an angle sequence line segment group data piece r3 in which the line segment data pieces k2 and k5 are connected.

Returning to the main processing in FIG. 4, the CPU 11 connects the angle sequence line segment group data pieces that are stored in the line segment group data storage area 154 that correspond to the same thread color (Step S13). Any one of various known techniques may be used as the method for connecting the angle sequence line segment group data pieces. For example, one of the angle sequence line segment group data pieces may be designated as a starting line segment group, one end of the starting line segment group may be designated as a starting endpoint, and the other end of the starting line segment group may be designated as an ending endpoint. The CPU 11 searches for another angle sequence line segment group data piece that has the endpoint that is closest to the ending endpoint of the starting line segment group. The CPU 11 sets the angle sequence line segment group data piece that is found as the starting line segment group, then searches again in the same manner for another angle sequence line segment group data piece. The CPU 11 may perform the processing described above for all of the angle sequence line segment group data pieces that correspond to the same thread color and may set a connecting sequence such that the endpoints of the angle sequence line segment group data pieces that are close to one another are connected (for details, refer to Japanese Laid-Open Patent Publication No. 2001-259268 and the like).

For example, if the angle sequence line segment group data pieces r1 to r3 that are shown in FIG. 7 are connected at their closest endpoints as described above, then, as shown in FIG. 8, a color-specific line segment group data piece is generated in which the plurality of the line segment data pieces k0 to k5 are connected.

Next, the CPU 11 determines whether the processing that is described above has been completed for all of the thread colors that are stored in the thread color correspondence table (Step S15). If the processing has not been completed for all of the thread colors (NO at Step S15), the CPU 11 performs the processing at Steps S9 to S13 for the unprocessed thread colors. On the other hand, if the processing has been completed for all of the thread colors (YES at Step S15), the CPU 11 generates the embroidery data that will be used by the embroidery sewing machine 3 in the embroidery operation, based on the angle sequence line segment group data pieces that have been connected for each of the thread colors at Step S13 (that is, the color-specific line segment group data sets) (Step S17). The embroidery data may be generated by converting the starting endpoint, the ending endpoint, and the color component that are specified by each of the line segment data pieces for the same color component into the starting endpoint, the ending endpoint, and the thread color, respectively, for each of the line segments for the stitches, in the same manner as in a known embroidery data generating method based on a photographic image.

As explained above, in the embroidery data generating device 1 according to the first embodiment, in a case where the distance d1 from the ending endpoint of the starting line segment L1 to the endpoint of the candidate line segment is within the range of the distance threshold value d and the angular difference α1 between the starting line segment L1 and the candidate line segment is within the range of the angle threshold value α, the CPU 11 sets the candidate line segment as the candidate line segment L2 that is connected to the starting line segment L1. The CPU 11 also generates the angle sequence line segment group data piece in which the plurality of the line segment data pieces are connected from the starting line segment data piece to the last line segment data piece. The CPU 11 further generates the embroidery data based on the angle sequence line segment group data pieces whose endpoints are connected in order by proximity (that is, the color-specific line segment group data pieces).

Thus, sharp bends and abrupt reversals of direction that occur in the stitches of the embroidered pattern may be reduced when the embroidering is performed by the embroidery sewing machine 3 based on the embroidery data that is generated by the embroidery data generating device 1. The embroidered pattern may therefore be produced by natural stitches. In particular, the line segment data pieces are connected such that the endpoints of the line segments that are specified by the line segment data pieces are close to one another and the angular difference of the line segments is in a specified range. This makes it possible to reduce the distance and the curvature from one stitch to the next in the embroidered pattern. It is also possible to connect a plurality of the line segment data pieces efficiently, including the line segment data pieces for which the distance between the endpoints is long and the angular difference is large. It therefore becomes possible to reduce the processing time and the processing load that are required to generate the embroidery data.

Incidentally, the CPU 11 may also perform the processing described below instead of the processing from Steps S41 to S49 of the angle sequence line segment group generation processing that is shown in FIG. 5. The CPU 11 calculates the angular difference α1 at Step S41, and determines at Step S43 whether the angular difference α1 is less than the angle threshold value α. The CPU 11 then calculates the distance d1 at Step S45, determines at Step S46 whether the distance d1 is equal to or less than the distance threshold value d, and determines at Step S47 whether the distance d1 is equal to the distance threshold value d. Then the CPU 11 determines at Step S48 whether the current angular difference α1 that was calculated at Step S41 is less than an angle α2, and at Step S49, changes the distance threshold value d to the current distance d1 that was calculated at Step S45. The angle α2 is set to the initial value to which the angle threshold value α was set at Step S33. If the distance d1 is equal to the distance threshold value d (YES at Step S47), the CPU 11 stores the line segment data piece in which the angular difference α1 is the smallest as the candidate line segment L2. At Step S49, the CPU 11 also changes the angle α2 to the current angular difference α1 that was calculated at Step S41. In this case, when Steps S39 to S49 are repeatedly performed, of the plurality of the candidate line segments that may be connected to the starting line segment L1, the line segment data piece for which the angular difference α1 is less than the angle threshold value α and the distance d1 from the starting line segment L1 is the shortest will be stored as the candidate line segment L2. Furthermore, in a case where there is a plurality of line segment data pieces for which the distance d1 is the shortest, the CPU 11 selects the line segment data piece for which the angular difference α1 is the least and stores the line segment data piece as the candidate line segment L2. Thus, in a case where there is a plurality of line segment data pieces that may be connected to the starting line segment L1 and for which the distance d1 is equal, it is possible to connect the starting line segment L1 to the candidate line segment L2 for which the curvature from one stitch to the next will be the least when the embroidery sewing machine 3 performs the embroidering.

For example, in FIG. 6, of the line segment data pieces k3 and k4 that are within the ranges of the distance threshold value d that was set at Step S31 and the angle threshold value α that was set at Step S33, the line segment data piece k4, whose distance d1 from the starting line segment L1 is the shortest, will be stored as the candidate line segment L2. Thus, in a case where there is a plurality of line segment data pieces that may be connected to the starting line segment L1, it is possible to connect the starting line segment L1 to the candidate line segment L2 for which the distance from one stitch to the next will be the least when the embroidery sewing machine 3 performs the embroidering.

An embroidery data generating device 1 according to a second embodiment will be explained with reference to FIGS. 9 to 15. Hereinafter, structural elements that are the same as in the first embodiment are denoted by the same symbols, and only points that are different from the first embodiment will be explained.

The processing by which the embroidery data generating device 1 according to the second embodiment generates the embroidery data based on the image data will be explained with reference to FIGS. 9 to 15. Main processing that is shown in FIG. 9 is performed by the CPU 11 of the embroidery data generating device 1 based on an embroidery data generating program.

Figure 9:
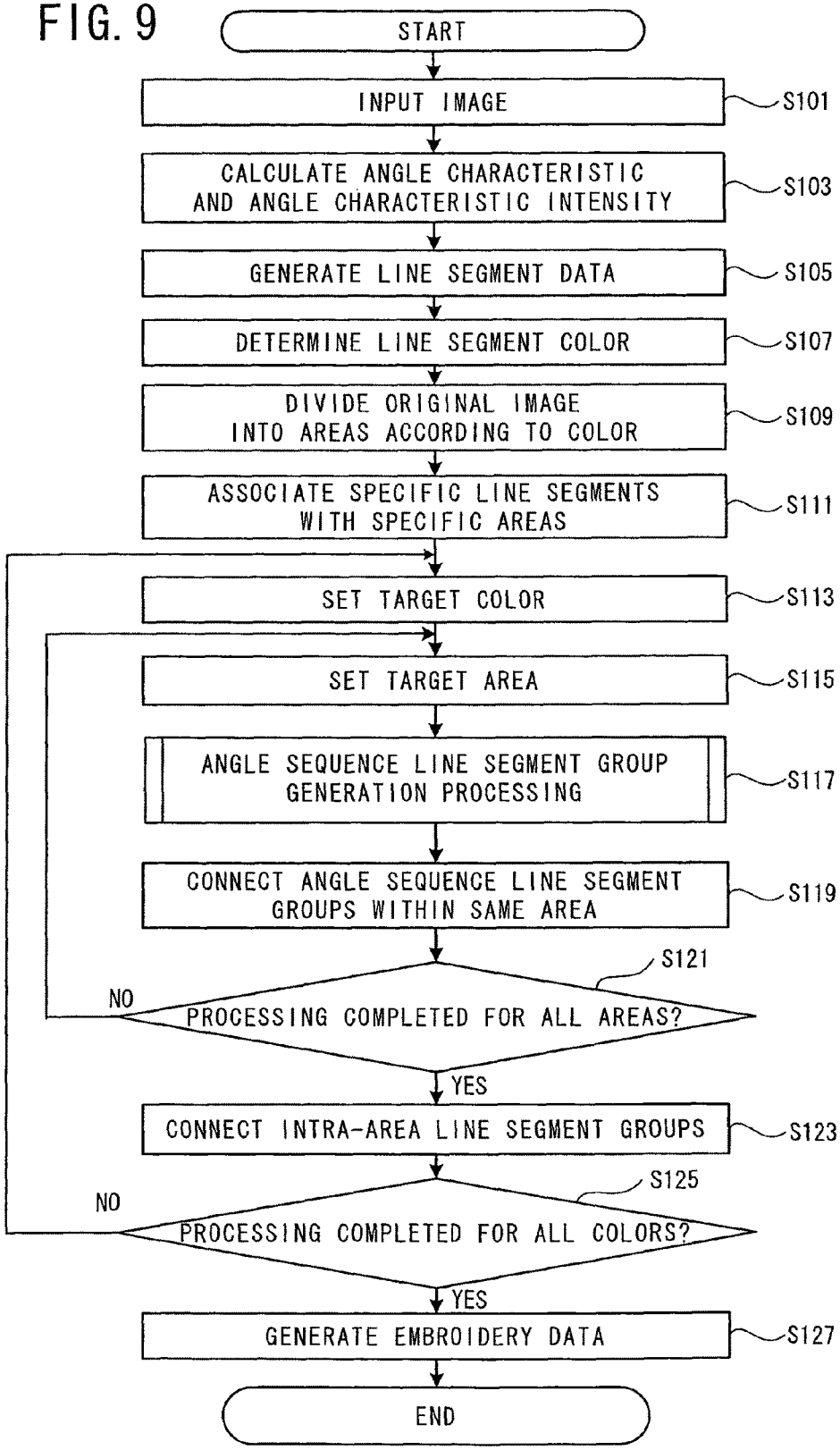
FIG. 9 is a flowchart that shows main processing in an embroidery data generating device according to a second embodiment.
Figure 10:
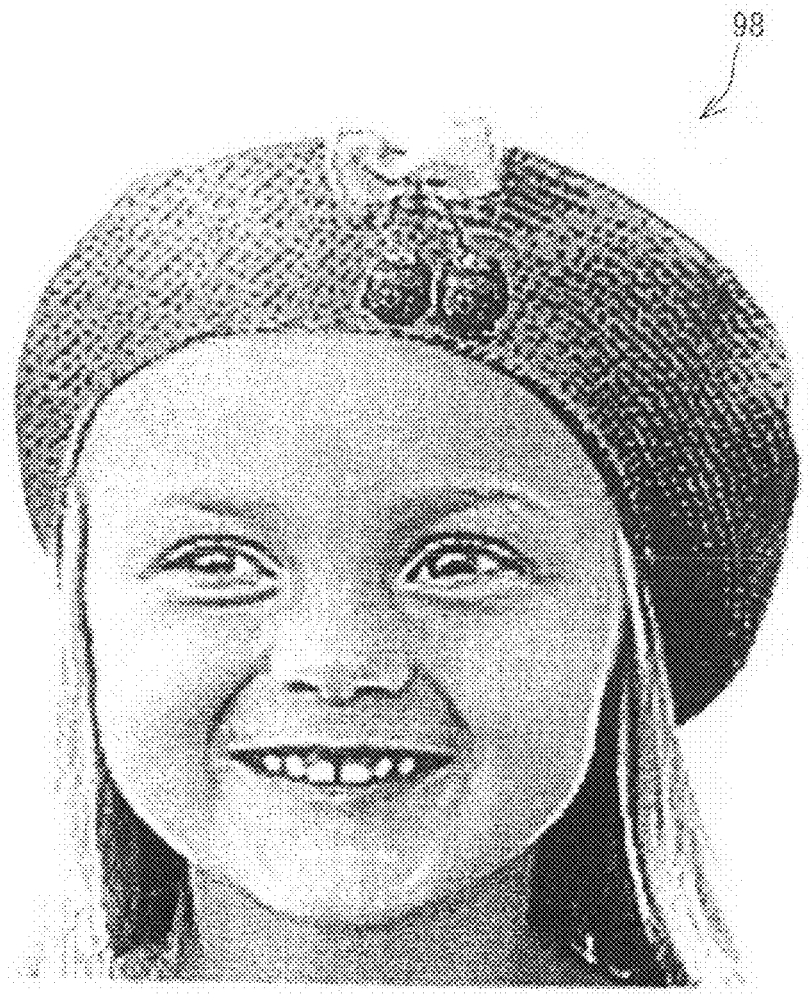
FIG. 10 is an example that shows an original image of image data.
Figure 11:
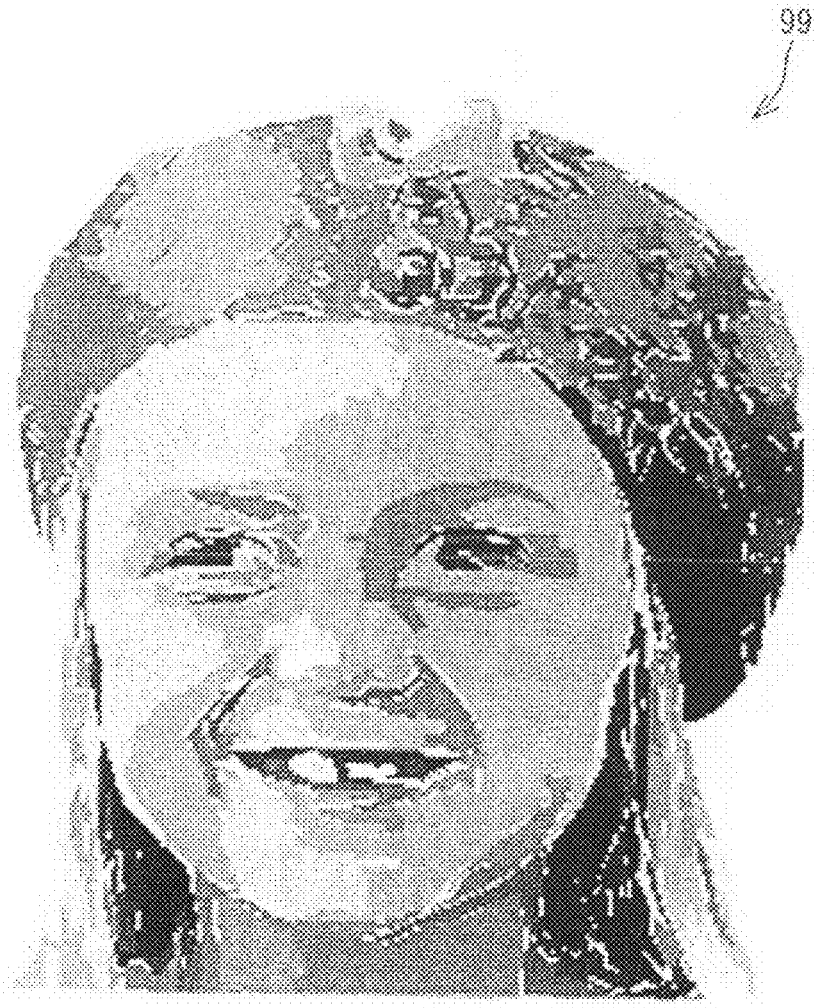
FIG. 11 is an example that shows a case in which the image data for the image that is shown in FIG. 10 has been converted into divided area data.

In the main processing of the present embodiment, as shown in FIG. 9, the CPU 11, in the same manner as at Steps S1 to S7, performs the input of the image data (Step S101), the calculation of the angle characteristic and the angle characteristic intensity (Step S103), the generation of the line segment data pieces (Step S105), and the determination of the color components for the line segment data pieces (Step S107), in that order. The CPU 11 also takes the image data (the original image) that was inputted at Step S101 and divides the data into areas according to color (Step S109). The method that is used for performing the division into areas according to color may be the following known method, for example. Representative colors of the original image may be determined by the median cut algorithm, and the value of each pixel in the original image may be replaced by the closest representative color. The image may then be divided into areas according to color by using noise reduction to delete extremely small areas. Another known method may also be used. In concrete terms, an original image 98 that is shown in FIG. 10 is converted at Step S109 into a divided area data 99 that is configured from the areas that are divided according to color, as shown in FIG. 11. The CPU 11 assigns a unique area number to each of the divided areas that are shown in the divided area data 99 and stores the divided areas in the RAM 12.

Next, the CPU 11 associates each of the line segment data pieces that were generated at Step S105 with one of the divided areas that are stored in the RAM 12 (Step S111). Specifically, the CPU 11 classifies each of the line segment data pieces that are stored in the line segment data storage area 153 according to the divided area. The association between the line segment data piece and the divided area is determined according to the divided area in which the midpoint of the line segment that is specified by the line segment data piece is located. Each of the line segment data pieces that are generated at Step S105 may thus be allocated to one of the divided areas such that the each of the line segment data pieces corresponds to a location of the line segment data piece in the original image 98.

Figure 12:
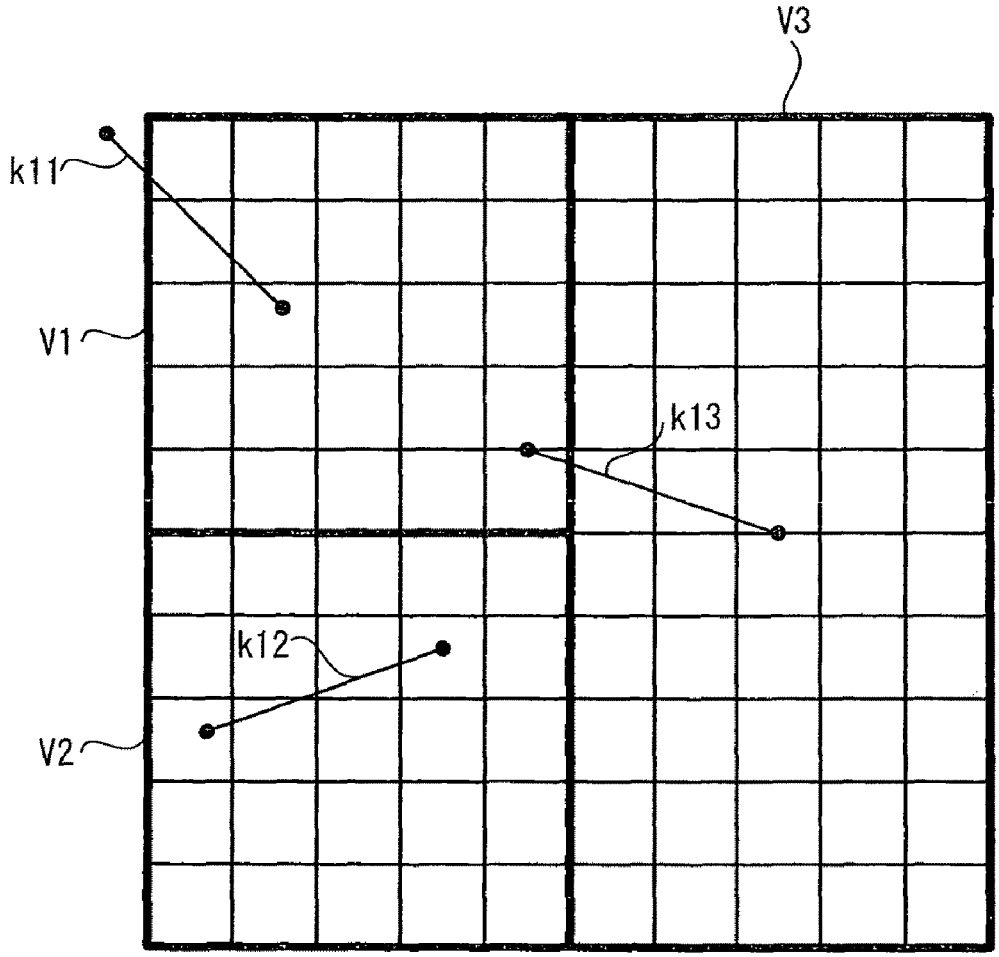
FIG. 12 is a figure that shows a correspondence relationship between divided areas and line segment data pieces.

For example, a case is considered where the original image is divided into three divided areas, V1, V2, and V3, at Step S109, as shown in FIG. 12. It is also considered that three line segment data pieces, k11, k12, and k13, are arranged in the RAM 12. In this case, the midpoint of the line segment that is specified by the line segment data piece k11 is located in the divided area V1, so at Step S111, the line segment data piece k11 is associated with the divided area V1. In the same manner, the line segment data pieces k12 and kl3 are associated with the divided areas V2 and V3, respectively.

Next, the CPU 11 sets the target color in the same manner as at Step S9, in order to perform the subsequent processing (Steps S113 to S125) for each of the thread colors (Step S113). The CPU 11 also sets a target area in order to perform the subsequent processing (Steps S115 to S121) for each of the divided areas (Step S115). The target area is the divided area for which the processing is to be performed. Next, in the same manner as at Step S11, the CPU 11 performs the angle sequence line segment group generation processing as shown in FIG. 5, to generate the angle sequence line segment group data pieces for the target color that was set at Step S113 and the target area that was set at Step S115 (Step S117). At Step S117, the angle sequence line segment group data pieces are generated only for the line segment data pieces that have the same color component as the current target color and are also associated with the current target area.

The CPU 11 generates an intra-area line segment group data piece by connecting the angle sequence line segment group data pieces that reside within the same divided area (that is, the current target area) (Step S119). Specifically, the CPU 11 connects the angle sequence line segment group data pieces that were generated at Step S117 at their closest endpoints, in the same manner as at Step S13. Thus, the color-specific line segment group data piece (hereinafter referred to as the intra-area line segment group data piece) that corresponds to the current target color is generated by connecting, in a continuous series, a plurality of the angle sequence line segment group data pieces that are associated with the current target area. The generated intra-area line segment group data piece is stored in the line segment group data storage area 154.

The CPU 11 determines whether the processing that is described above has been completed for all of the divided areas that are based on the original image (Step S121). If the processing has not been completed for all of the divided areas (NO at Step S121), the CPU 11 performs the processing at Steps S115 to S119 for an unprocessed divided area. If the processing has been completed for all of the divided areas (YES at Step S121), the CPU 11 connects the intra-area line segment group data pieces that were generated for the divided areas at Step S119 (Step S123). That is, the CPU 11 connects the intra-area line segment group data pieces that were generated for the respective divided areas and for the current target color at their closest endpoints across all of the divided areas, in the same manner as at Step S13. Thus, a common line segment group data piece that corresponds to the current target color is generated by connecting, in a continuous series across all of the divided areas, all of the intra-area line segment group data pieces that correspond to the current target color. The generated common line segment group data piece is stored in the line segment group data storage area 154.

The CPU 11 determines whether the processing that is described above has been completed for all of the thread colors that are stored in the thread color correspondence table (Step S125). If the processing has not been completed for all of the thread colors (NO at Step S125), the CPU 11 performs the processing at Steps S113 to S123 for an unprocessed thread color. If the processing has been completed for all of the thread colors (YES at Step S125), the CPU 11 generates the embroidery data in the same manner as at Step S17, based on the common line segment group data pieces that were generated for the respective thread colors at Step S123 (Step S127).

Figure 13:
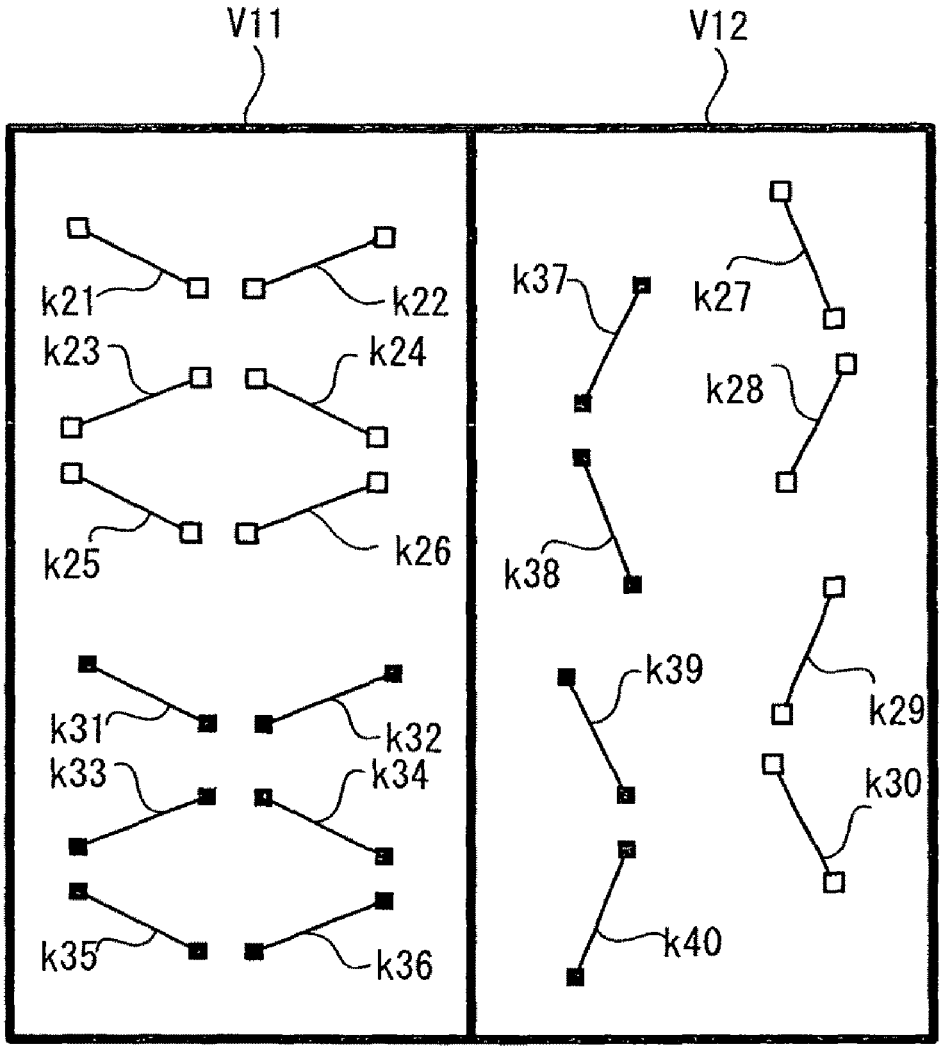
FIG. 13 is a figure that shows a process of connecting line segment data pieces that are allocated to divided areas, according to the second embodiment.

The processing that is described above will be explained more concretely with reference to FIGS. 13 to 16. In this example, divided areas V11 and V12 are generated at Step S109 based on the original image, as shown in FIG. 13. Next, at Step S111, line segment data pieces k21 to k26 and k31 to k36 are associated with the divided area V11, and line segment data pieces k27 to k30 and k37 to k40 are associated with the divided area V12. For the line segment data pieces k21 to k30, the endpoints of which are indicated by white squares, the color is set to red at Step S107. For the line segment data pieces k31 to k40, the endpoints of which are indicated by black squares, the color is set to blue at Step S107.

Figure 14:
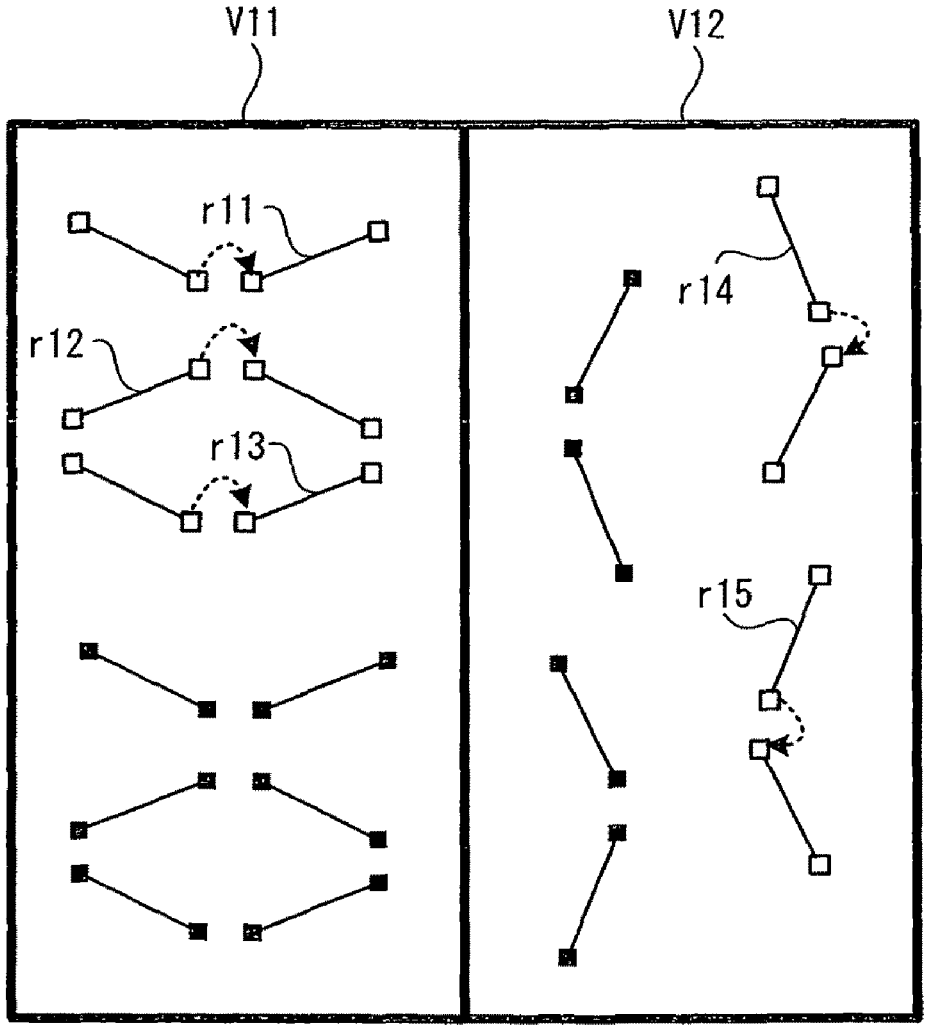
FIG. 14 is a figure that shows the process of connecting the line segment data pieces that are allocated to divided areas, according to the second embodiment.
Figure 15:
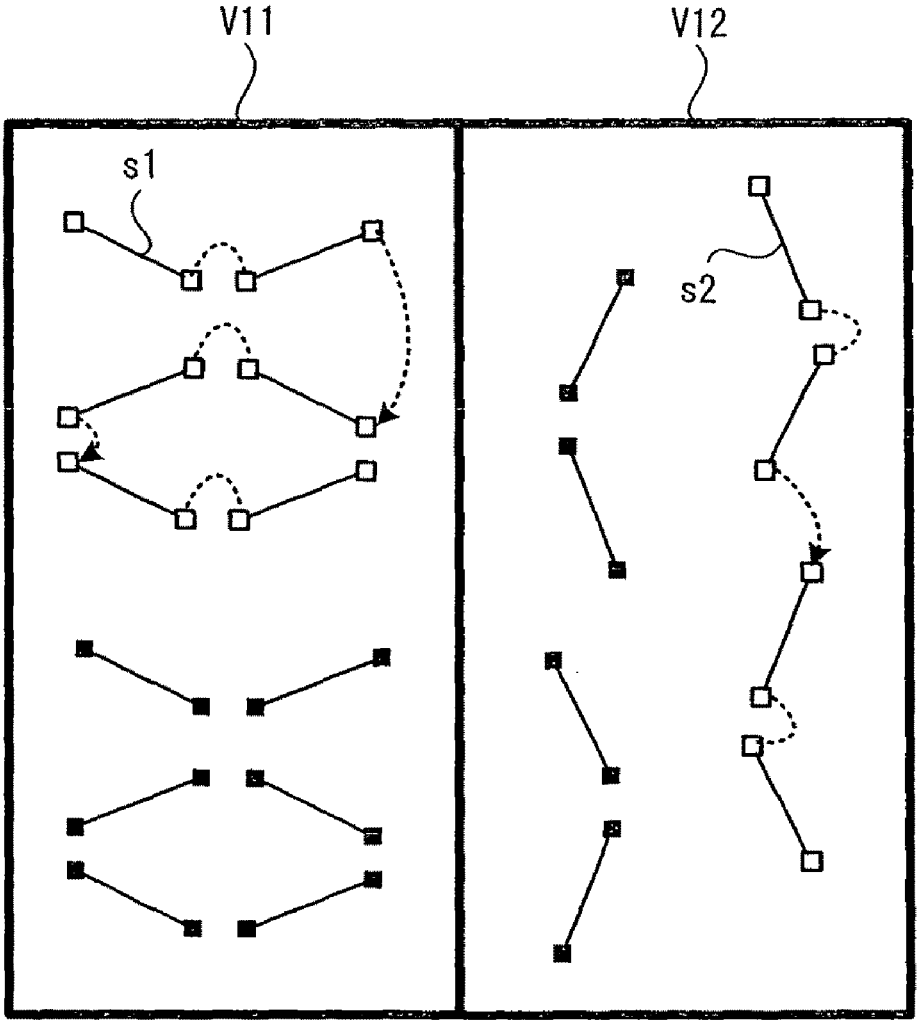
FIG. 15 is a figure that shows the process of connecting the line segment data pieces that are allocated to divided areas, according to the second embodiment.

In the example, a case is considered where, with the line segment data pieces k21 to k40 in a state of being associated with the divided areas V11 and V12, as shown in FIG. 13, the angle sequence line segment group data pieces are generated for the current target color (in this case, red). For the first target area (in this case, V11), an angle sequence line segment group data piece r11 is generated by connecting the line segment data pieces k21 and k22, an angle sequence line segment group data piece r12 is generated by connecting the line segment data pieces k23 and k24, and an angle sequence line segment group data piece r13 is generated by connecting the line segment data pieces k25 and k26, as shown in FIG. 14 (Step S117). Next, an intra-area line segment group data piece s1 that corresponds to the target color red is generated by connecting the angle sequence line segment group data pieces r11, r12, and r13 in the target area V11, as shown in FIG. 15 (Step S117).

Figure 16:
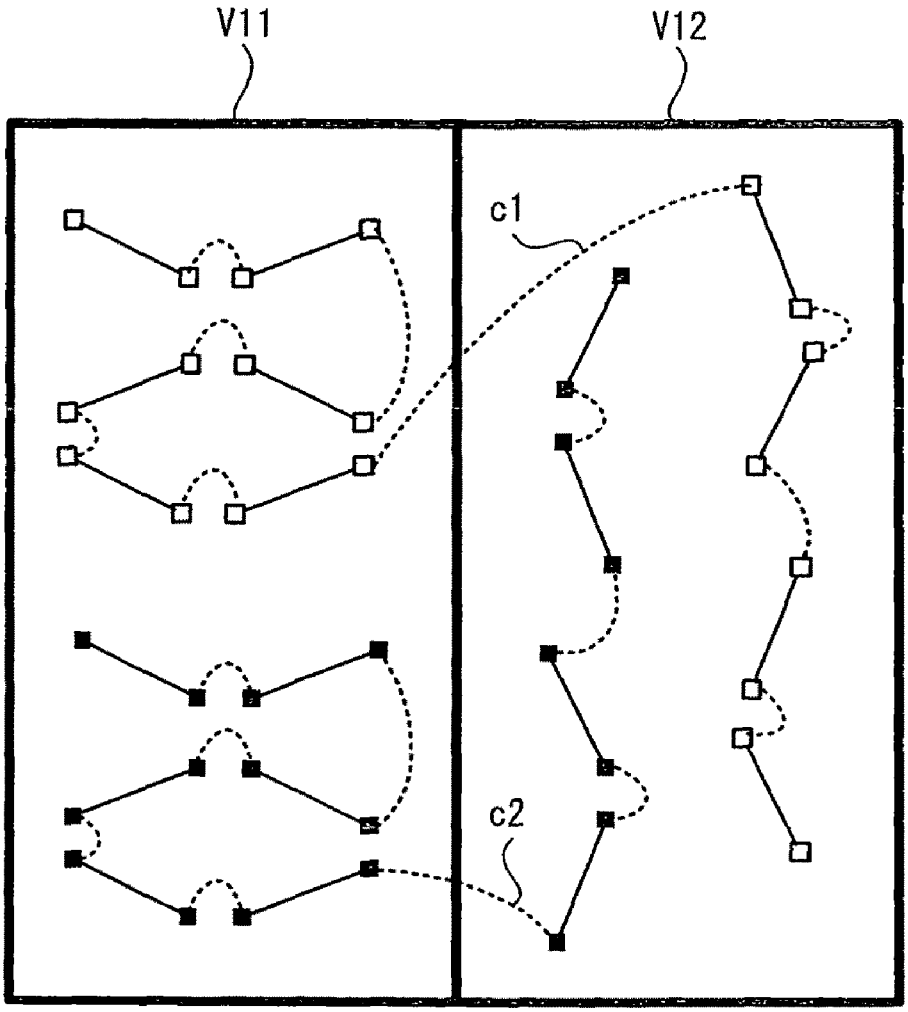
FIG. 16 is a figure that shows the process of connecting the line segment data pieces that are allocated to divided areas, according to the second embodiment.

In the same manner, for the next target area (in this case, V12), an angle sequence line segment group data piece r14 is generated by connecting the line segment data pieces k27 and k28, and an angle sequence line segment group data piece r15 is generated by connecting the line segment data pieces k29 and k30, as shown in FIG. 14. Next, an intra-area line segment group data piece s2 that corresponds to the target color red is generated by connecting the angle sequence line segment group data pieces r14 and r15, as shown in FIG. 15 (Steps S115 to S121). Next, as shown in FIG. 16, a common line segment group data piece c1 that corresponds to the target color red is generated by connecting the intra-area line segment group data pieces s1 and s2 (Step S123).

In the same manner, for the next target color (in this case, blue), angle sequence line segment group data pieces are generated based on the line segment data pieces k31 to k36 that are associated with the first target area (in this case, V11), and then an intra-area line segment group data piece that corresponds to the target color blue is generated. Additional angle sequence line segment group data pieces are generated based on the line segment data pieces k37 to k40 that are associated with the next target area (in this case, V12), and then an intra-area line segment group data piece that corresponds to the target color blue is generated. Next, as shown in FIG. 16, a common line segment group data set c2 that corresponds to the target color blue is generated by connecting the intra-area line segment group data pieces that correspond to the target color blue (Steps S113 to S125). Finally, the embroidery data is generated based on the common line segment group data pieces c1 and c2 (Step S127).

As explained above, in the embroidery data generating device 1 according to the second embodiment, the CPU 11 allocates each of a plurality of the line segment data pieces to one of the areas that are divided according to color based on the image data. The CPU 11 also connects a plurality of the line segment data pieces within each of the divided areas. The CPU 11 then generates, for each of the divided areas, the angle sequence line segment group data piece that includes the plurality of the line segment data pieces that are connected from the first line segment data piece to the last line segment data piece. Next, the CPU 11 generates the intra-area line segment group data pieces by connecting the endpoints of the angle sequence line segment group data pieces in order by their proximity. Then the CPU 11 generates the common line segment group data piece for all of the divided areas by connecting the endpoints of the intra-area line segment group data pieces in order by their proximity.

This makes it possible to inhibit line segment data pieces that reside in different divided areas (that is, separated locations in the image) from being connected to one another, even though the line segment data pieces have the same color. The occurrence of jump stitches in the embroidered pattern may therefore be inhibited as much as possible. It is also possible to connect a plurality of the line segment data pieces efficiently, including the line segment data pieces for which the distance between the endpoints is long and the angular difference is large, and including the line segment data pieces for which the divided areas are different. It therefore becomes possible to reduce the processing time and the processing load that are required to generate the embroidery data.

Furthermore, in the second embodiment, the angle sequence line segment group generation processing for the current target color (Step S117) is performed in the same manner as the angle sequence line segment group generation processing at Step S11, as shown in FIG. 5. Therefore, in the same manner as in the first embodiment, sharp bends and abrupt reversals of direction that occur in the stitches of the embroidered pattern may be reduced when the embroidering is performed by the embroidery sewing machine 3 based on the embroidery data that is generated by the embroidery data generating device 1. The embroidered pattern may therefore be produced by natural stitches.

In the second embodiment, the angle sequence line segment group generation processing that is described above (Step S117) may not need to be used as long as the line segment data pieces within each of the divided areas can be connected appropriately. For example, the line segment data pieces within each of the divided areas may be connected at their closest endpoints, in the same manner as at Step S13. In this case, in the main processing that is shown in FIG. 9, the CPU 11 may perform processing that connects the line segment data pieces within the same divided area (that is, within the current target area) at their closest endpoints to generate the intra-area line segment group data pieces, instead of performing the processing at Steps S117 and S119.

An embroidery data generating device 1 according to a third embodiment will be explained with reference to FIGS. 17 to 21. Hereinafter, structural elements that are the same as in the first and second embodiments are denoted by the same symbols, and only points that are different from the first and second embodiments will be explained.

The processing procedure by which the embroidery data generating device 1 according to the third embodiment generates the embroidery data based on the image data will be explained with reference to FIGS. 17 to 21. Main processing that is shown in FIG. 17 is performed by the CPU 11 of the embroidery data generating device 1 based on an embroidery data generating program.

Figure 17:
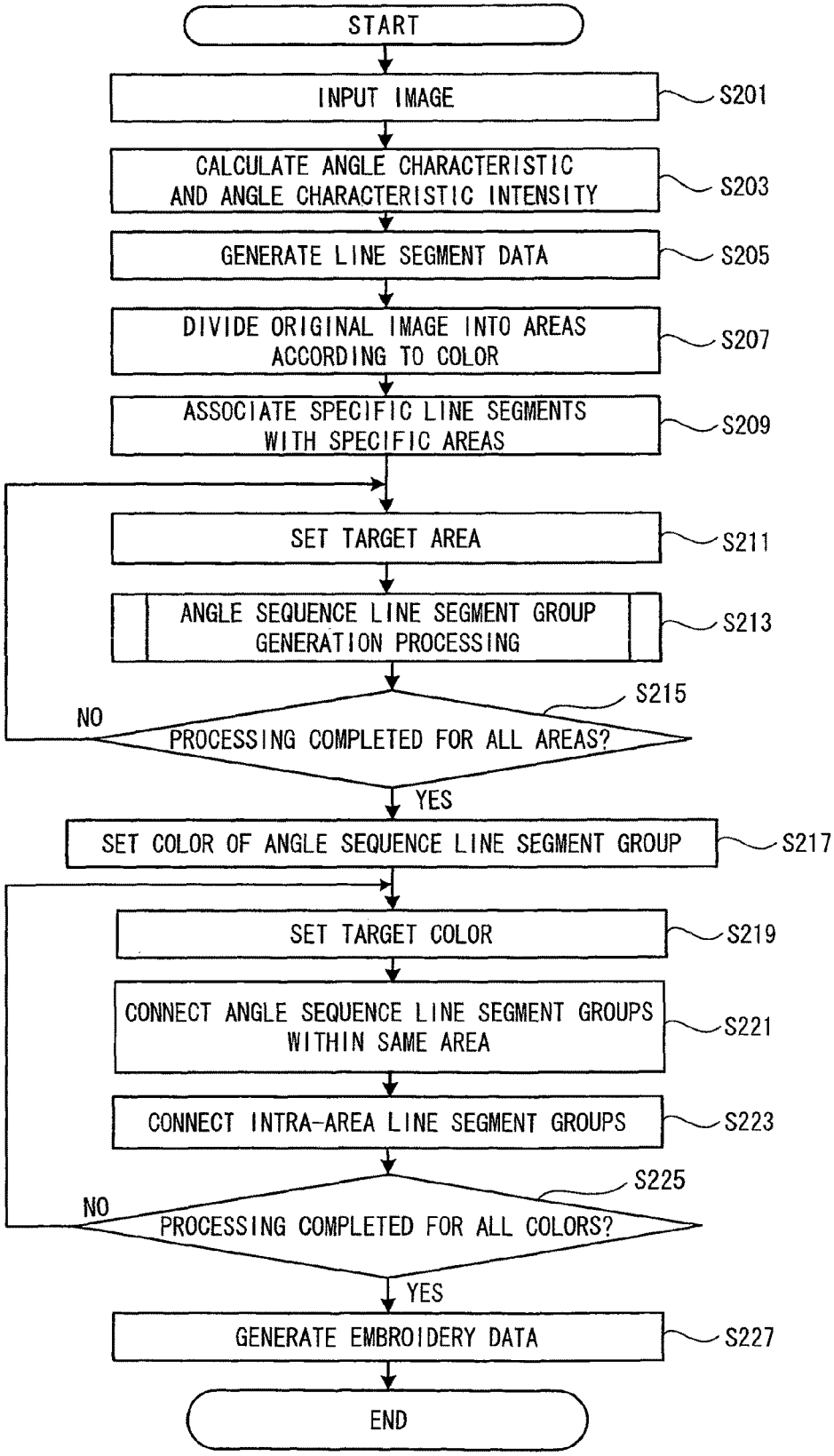
FIG. 17 is a flowchart that shows main processing in an embroidery data generating device according to a third embodiment.

In the main processing of the present embodiment, as shown in FIG. 17, the CPU 11, in the same manner as at Steps S101 to S111, performs the input of the image data (Step S201), the calculation of the angle characteristic and the angle characteristic intensity (Step S203), the generation of the line segment data pieces (Step S205), the dividing of the image data into areas according to color (Step S207), and the associating of the line segment data pieces with the divided areas (Step S209). Processing that corresponds to the determination of the color components for the line segment data pieces (Step S107) is not performed. The line segment data pieces that are stored in the line segment data storage area 153 therefore do not have color components.

In order to perform the subsequent processing (Steps S211 to S215) for each of the divided areas, the CPU 11 sets the target area in the same manner as at Step S115 (Step S211). Next, the CPU 11 performs the angle sequence line segment group generation processing as shown in FIG. 5 that generates the angle sequence line segment group data pieces for the target area that was set at Step S211, in the same manner as at Step S11 (Step S213). At Step S213, the angle sequence line segment group data pieces are generated by taking the line segment data pieces that are associated with the current target area and connecting the line segment data pieces without regard to color components and target colors.

The CPU 11 determines whether the processing that is described above has been completed for all of the divided areas based on the original image (Step S215). If an unprocessed divided area exists (NO at Step S215), the CPU 11 performs the processing at Steps S211 and S213 for the unprocessed divided area. If no unprocessed divided areas exist (YES at Step S215), the CPU 11 determines the color of each of the angle sequence line segment group data pieces that were generated for the divided areas at Step S213 (Step S217). Each of the angle sequence line segment group data pieces is configured from a plurality of the line segment data pieces and, when converted into the embroidery data, is expressed as an assemblage of continuous line segments of a single color. In other words, when the embroidering is performed by the embroidery sewing machine 3 based on the embroidery data, each of the angle sequence line segment group data pieces is expressed such that a plurality of stitches of a single thread color form a continuous series. Therefore, at Step S217, one corresponding color (that is, the thread color) is set for each of the angle sequence line segment group data pieces.

The same sort of known technique that is used in the embroidery data generating method based on the photographic image may be used for the determination of the color for each of the angle sequence line segment group data pieces that is performed at Step S217. For example, Japanese Laid-Open Patent Publication No. 2001-259268 discloses an embroidery data generating method based on the photographic image, the relevant portions of which are herein incorporated by reference. For example, the CPU 11 may first set the color for one of the angle sequence line segment group data pieces to the color that is closest to the color in the original image. Next, the CPU 11 may set the color for another one of the angle sequence line segment group data pieces to compensate for the difference between the color that was set for the first of the line segment data pieces and the color in the original image. The CPU 11 may then repeat this processing until the colors have been set for all of the angle sequence line segment group data pieces.

Next, in order to perform the subsequent processing for each of the target colors (Steps S219 to S225), the CPU 11 sets the target color in the same manner as at Step S115 (Step S219). The CPU 11 then connects the angle sequence line segment group data pieces within the same divided area in the same manner as at Step S119 (Step S221). Thus, for each of the divided areas, an intra-area line segment group data piece that corresponds to the current target color is generated by connecting, in a continuous series, a plurality of the angle sequence line segment group data pieces that correspond to the current target color. Next, in the same manner as at Step S123, the CPU 11 connects intra-area line segment group data pieces that were generated at Step S221 (Step S223). Thus a common line segment group data piece that corresponds to the current target color is generated by connecting, in a continuous series across all of the divided areas, the intra-area line segment group data pieces that correspond to the current target color.

Next, the CPU 11 determines whether the processing that is described above has been completed for all of the thread colors that are stored in the thread color correspondence table (Step S225). If an unprocessed thread color exists (NO at Step S225), the CPU 11 performs the processing at Steps S219 to S223 for the unprocessed thread color. If no more unprocessed thread colors exist (YES at Step S225), the CPU 11 generates the embroidery data in the same manner as at Step S127, based on the common line segment group data pieces that have been generated for the respective thread colors at Step S223 (Step S227).

Figure 18:
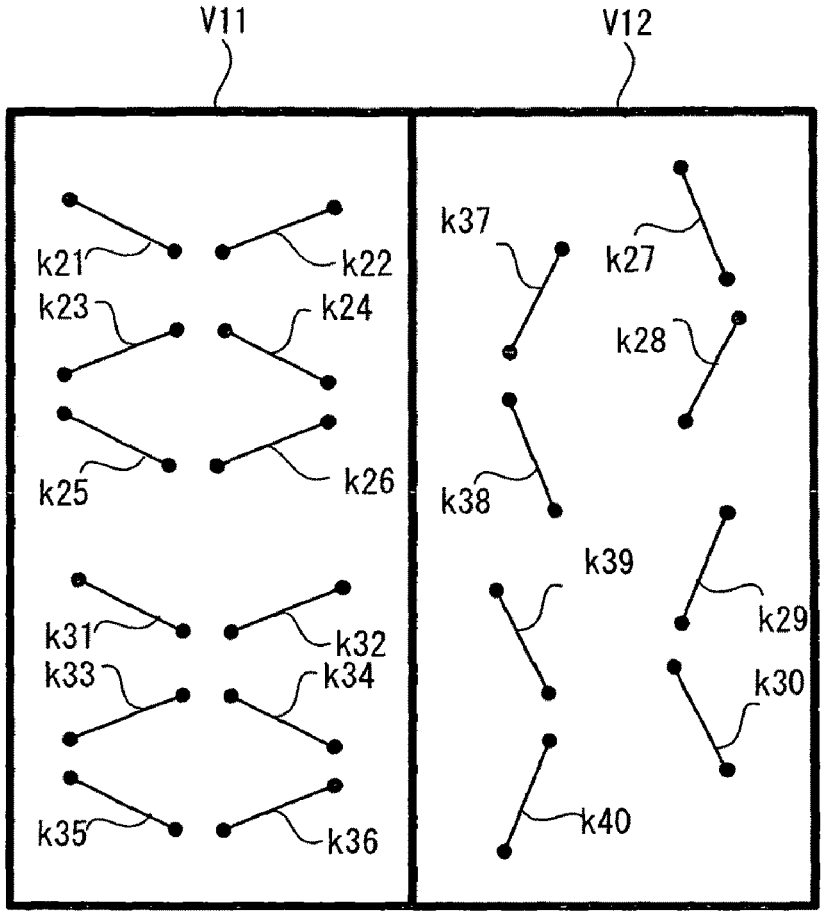
FIG. 18 is a figure that shows a process of connecting the line segment data pieces that are allocated to divided areas, according to the third embodiment.

The processing that is described above will be explained more concretely with reference to FIGS. 18 to 21. In this example, divided areas V11 and V12 are generated at Step S207 based on the original image, as shown in FIG. 18. Next, at Step S209, line segment data pieces k21 to k26 and k31 to k36 are associated with the divided area V11, and line segment data pieces k27 to k30 and k37 to k40 are associated with the divided area V12. The line segment data pieces k21 to k40, the endpoints of which are indicated by black dots, do not have any color components (that is, the colors have not been set).

Figure 19:
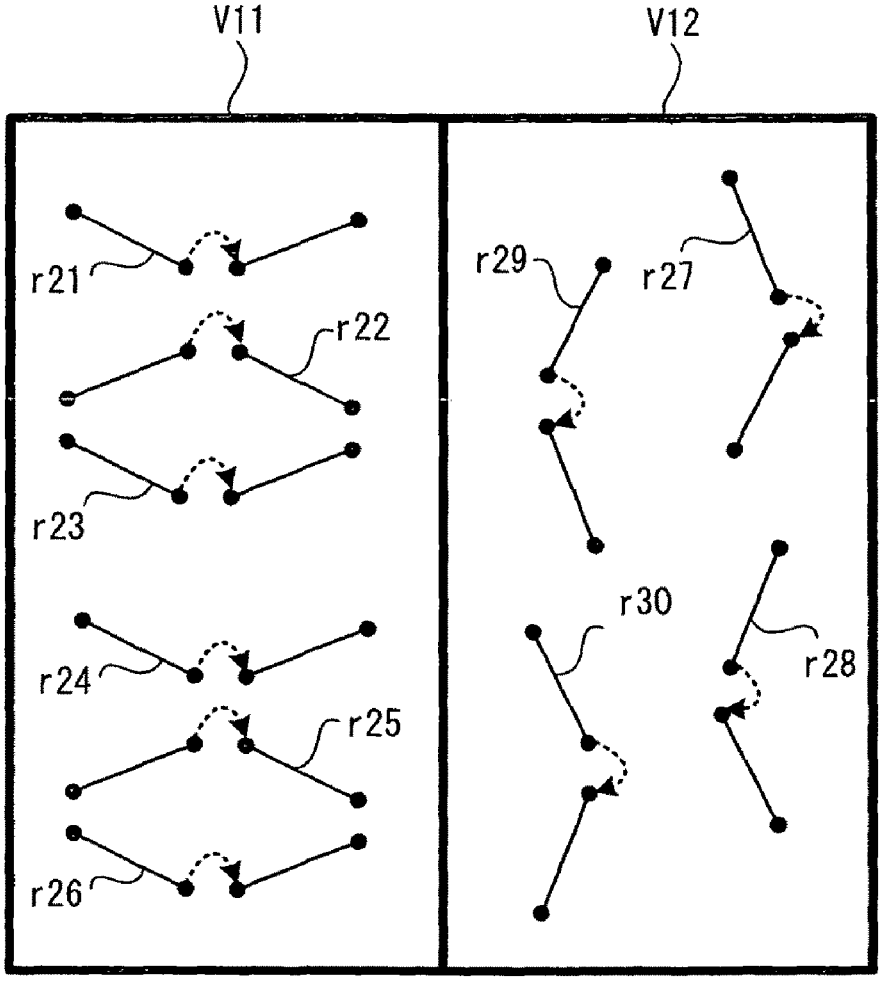
FIG. 19 is a figure that shows the process of connecting the line segment data pieces that are allocated to divided areas, according to the third embodiment.

In the example, a case is considered where the angle sequence line segment group data pieces are generated when the line segment data pieces k21 to k40, for which the colors have not been set, are in a state of being associated with the divided areas V11 and V12, as shown in FIG. 18. For the first target area (in this case, V11), an angle sequence line segment group data piece r21 is generated by connecting the line segment data pieces k21 and k22, and an angle sequence line segment group data piece r22 is generated by connecting the line segment data pieces k23 and k24, as shown in FIG. 19. In addition, an angle sequence line segment group data piece r23 is generated by connecting the line segment data pieces k25 and k26, and an angle sequence line segment group data piece r24 is generated by connecting the line segment data pieces k31 and k32. Finally, an angle sequence line segment group data piece r25 is generated by connecting the line segment data pieces k33 and k34, and an angle sequence line segment group data piece r26 is generated by connecting the line segment data pieces k35 and k36 (Step S213). In the same manner, for the next target area (in this case, V12), an angle sequence line segment group data piece r27 is generated by connecting the line segment data pieces k27 and k28, and an angle sequence line segment group data piece r28 is generated by connecting the line segment data pieces k29 and k30. In addition, an angle sequence line segment group data piece r29 is generated by connecting the line segment data pieces k37 and k38, and an angle sequence line segment group data piece r30 is generated by connecting the line segment data pieces k39 and k40 (Steps S211 to S215).

Figure 20:
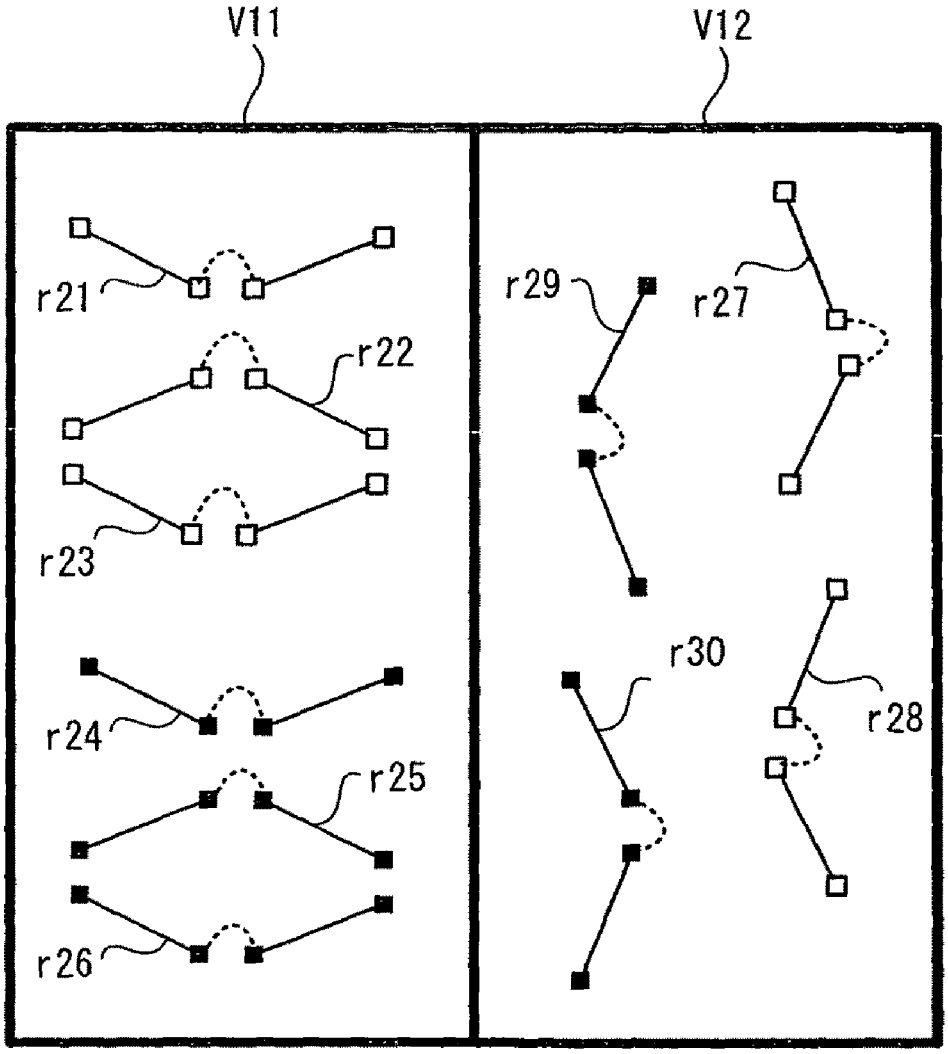
FIG. 20 is a figure that shows the process of connecting the line segment data pieces that are allocated to divided areas, according to the third embodiment.

Next, the colors of the angle sequence line segment group data pieces r21 to r30 are determined, as shown in FIG. 20 (Step S217). For the angle sequence line segment group data pieces r21 to r23, r27, and r28, the endpoints of which are indicated by white squares, the color is set to red. For the angle sequence line segment group data pieces r24 to r26, r29, and r30, the endpoints of which are indicated by black squares, the color is set to blue.

Figure 21:
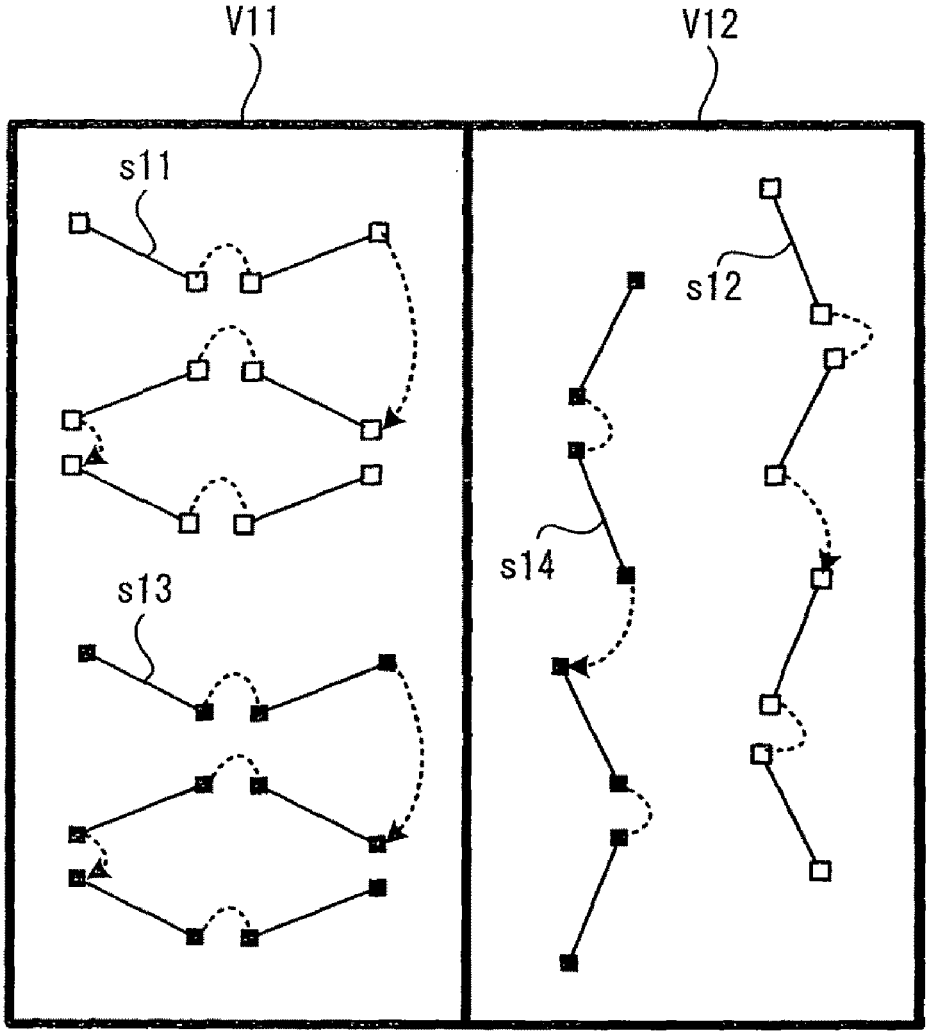
FIG. 21 is a figure that shows the process of connecting the line segment data pieces that are allocated to divided areas, according to the third embodiment.

Next, for the first target color (in this case, red), an intra-area line segment group data piece s11 is generated by connecting the angle sequence line segment group data pieces r21 to r23 that are associated with the first target area (in this case, V11), as shown in FIG. 21. Then an intra-area line segment group data piece s12 that corresponds to the target color red is generated by connecting the angle sequence line segment group data pieces r27 and r28 that are associated with the next target area (in this case, V12) (Step S221). Then a common line segment group data piece c1 that corresponds to the target color red is generated by connecting the intra-area line segment group data sets s11 and s12, as shown in FIG. 16 (Step S223). In the same manner, for the next target color (in this case, blue), an intra-area line segment group data piece s13 is generated by connecting the angle sequence line segment group data pieces r24 to r26 that are associated with the first target area (in this case, V11). An intra-area line segment group data piece s14 is generated by connecting the angle sequence line segment group data pieces r29 and r30 that are associated with the next target area (in this case, V12). A common line segment group data piece c2 that corresponds to the target color blue is generated by connecting the intra-area line segment group data pieces s13 and s14 (Steps S219 to S225). Finally, the embroidery data are generated based on the common line segment group data pieces c1 and c2 (Step S227).

As explained above, in the embroidery data generating device 1 according to the third embodiment, the CPU 11 allocates a plurality of the line segment data pieces to the areas that are divided according to color based on the image data. The CPU 11 then generates, for each of the divided areas, the angle sequence line segment group data piece that includes the plurality of the line segment data pieces that are connected from the first line segment data piece to the last line segment data piece. Next, the CPU 11 sets the thread color for each of the angle sequence line segment group data pieces based on the colors of the line segment groups that are specified by the angle sequence line segment group data pieces. The CPU 11 then generates the intra-area line segment group data pieces by taking the angle sequence line segment group data pieces that have the same thread color and connecting endpoints of the angle sequence line segment group data pieces in order by their proximity. Finally, the CPU 11 generates the common line segment group data piece for all of the divided areas by connecting the endpoints of the intra-area line segment group data pieces in order by their proximity.

Line segment data pieces that reside in different divided areas (that is, separated locations in the image) are thus inhibited from being connected to one another, even though the line segment data pieces have the same color. The occurrence of jump stitches in the embroidered pattern may therefore be inhibited as much as possible. It is also possible to connect a plurality of the line segment data pieces efficiently, including the line segment data pieces for which the distance between the endpoints is long and the angular difference is large, and including the line segment data pieces for which the divided areas are different. It therefore becomes possible to reduce the processing time and the processing load that are required to generate the embroidery data. In addition, setting the thread color after the plurality of the line segment data pieces are connected may inhibit the line segment data pieces that have the same color components from being arranged in an irregular manner. It is therefore possible to reduce further the distance and the curvature from one stitch to the next in the embroidered pattern.

Furthermore, in the third embodiment, the angle sequence line segment group generation processing for the current target area (Step S213) is performed in the same manner as the angle sequence line segment group generation processing at Step S11, as shown in FIG. 5. Therefore, in the same manner as in the first embodiment, sharp bends and abrupt reversals of direction that occur in the stitches of the embroidered pattern may be reduced when the embroidering is performed by the embroidery sewing machine 3 based on the embroidery data that are generated by the embroidery data generating device 1. The embroidered pattern may thus be produced by natural stitches.

In the third embodiment, priority may be given to connecting the angle sequence line segment group data pieces within the same divided area, as described above, as long as the angle sequence line segment group data pieces can be connected appropriately. For example, the angle sequence line segment group data pieces may not need to be connected within each of the divided areas. The angle sequence line segment group data pieces may also be connected for all of the divided areas. In this case, in the main processing that is shown in FIG. 17, the CPU 11 may perform processing that connects the angle sequence line segment group data pieces at their closest endpoints for all of the divided areas to generate the common line segment group data piece, instead of performing the processing at Steps S221 and S223.

The embroidery data generating device according to the present disclosure is not limited to the embodiments that are described above, and it is obvious that various modifications may be applied within the scope of the present disclosure. In the embodiments that are described above, a personal computer serves as the embroidery data generating device 1. The embroidery data generating program may also be stored in a sewing machine, and the embroidery data may also be generated in the sewing machine.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery data generating device comprising:

a line segment data generation device that generates a plurality of line segment data pieces based on image data being an aggregation of pixels, each of the plurality of line segment data pieces including an angle component;

a distance calculation device that calculates a distance from an ending endpoint of one of a plurality of line segments to an endpoint of another of the plurality of line segments, the plurality of line segments being respectively specified by the plurality of line segment data pieces generated by the line segment data generation device;

an angle calculation device that calculates an angle formed by the one of the plurality of line segments and the other of the plurality of line segments;

a connecting endpoint determination device that, based on a result of a calculation by the distance calculation device and a result of a calculation by the angle calculation device, determines which of endpoints of the plurality of line segments is a connecting endpoint to be connected to the ending endpoint;

a line segment connecting device that connects the plurality of line segments by connecting the ending endpoint and the connecting endpoint; and an embroidery data generation device that generates embroidery data for forming stitches following the plurality of line segments connected by the line segment connecting device.

2. The embroidery data generating device according to claim 1, wherein the connecting endpoint determination device finds a line segment that has an endpoint for which the distance calculated by the distance calculation device is within a first specified range and for which the angle calculated by the angle calculation device is within a second specified range, and determines that the endpoint of the found line segment that is within the first specified range is the connecting endpoint.

3. The embroidery data generating device according to claim 2, wherein the line segment connecting device includes:

a line segment group generating device that generates a line segment group including at least two of the plurality of line segments by sequentially connecting the ending endpoint and the connecting endpoint; and a line segment group connecting device that, in a case where a plurality of line segment groups are generated by the line segment group generating device, connects the plurality of line segment groups by connecting an unconnected endpoint of one of the plurality of line segment groups to an unconnected endpoint of another of the plurality of line segment groups being the closest unconnected endpoint to the unconnected endpoint of the one of the plurality of line segment groups.

4. The embroidery data generating device according to claim 2, wherein the angle calculation device calculates the angle in a case where the distance calculated by the distance calculation device is within the first specified range, and the connecting endpoint determination device determines that, among the endpoints of the line segments for which the angle has been calculated by the angle calculation device, the connecting endpoint is an endpoint for which the distance from the ending endpoint is the shortest.

5. The embroidery data generating device according to claim 2, wherein the angle calculation device calculates the angle in a case where the distance calculated by the distance calculation device is within the first specified range, and the connecting endpoint determination device determines that, among the line segments for which the angle has been calculated by the angle calculation device, the connecting endpoint is an endpoint of an line segment for which the angle is the smallest.

6. The embroidery data generating device according to claim 1, further comprising:

a divided area generating device that, based on color information in the image data, generates a plurality of divided areas into which an entire area of an image specified by the image data is divided; and a line segment allocation device that allocates each of the plurality of line segment data pieces to one of the plurality of divided areas, corresponding to a position, within the image, of a line segment specified by each of the plurality of line segment data pieces, wherein the distance calculation device calculates the distance from the ending endpoint of the one of the plurality of line segments to the endpoint of the other of the plurality of line segments, a line segment data piece specifying the one of the plurality of line segments and a line segment data piece specifying the other of the plurality of line segments being allocated to the same divided area.

7. The embroidery data generating device according to claim 6, wherein the connecting endpoint determination device finds a line segment that has an endpoint for which the distance calculated by the distance calculation device is within a first specified range and for which the angle calculated by the angle calculation device is within a second specified range, and determines that the endpoint of the found line segment that is within the first specified range is the connecting endpoint.

8. The embroidery data generating device according to claim 7, wherein the line segment connecting device includes:

a line segment group generating device that, for each of the plurality of divided areas, generates a line segment group including at least two of the plurality of line segments by sequentially connecting the ending endpoint and the connecting endpoint;

an intra-area line segment group generating device that, for each of the plurality of divided areas, in a case where a plurality of line segment groups are generated by the line segment group generating device, generates an intra-area line segment group including at least two of the plurality of line segment groups by connecting an unconnected endpoint of one of the plurality of line segment groups to an unconnected endpoint of another of the plurality of line segment groups being the closest unconnected endpoint to the unconnected endpoint of the one of the plurality of line segment groups; and an intra-area line segment group connecting device that, across all of the plurality of divided areas, connects the intra-area line segment groups generated by the intra-area line segment group generating device by connecting an unconnected endpoint of one of the intra-area line segment groups to an unconnected endpoint of another of the intra-area line segment groups being the closest unconnected endpoint to the unconnected endpoint of the one of the intra-area line segment groups.

9. The embroidery data generating device according to claim 8, further comprising:

a color setting device that, based on the image data, determines a color of each of the plurality of line segment groups generated by the line segment group generating device and, based on the color of each of the plurality of line segment groups, sets a thread color of an embroidery thread to be used to form stitches following each of the plurality of line segment groups, wherein the intra-area line segment group generating device generates the intra-area line segment group for line segment groups of which the thread color set by the color setting device is the same, and the intra-area line segment group connecting device connects the intra-area line segment groups of which the thread color set by the color setting device is the same.

10. The embroidery data generating device according to claim 6, wherein the line segment connecting device includes:

a line segment group generating device that, for each of the plurality of divided areas, generates a line segment group including at least two of the plurality of line segments by sequentially connecting the ending endpoint and the connecting endpoint;

a color setting device that, based on the image data, determines a color of each of line segment groups generated by the line segment group generating device and, based on the color of each of the line segment groups, sets a thread color of an embroidery thread to be used to form stitches following each of the line segment groups; and a line segment group connecting device that, across all of the plurality of divided areas, connects the line segment groups of which the thread color set by the color setting device is the same by connecting an unconnected endpoint of one of the line segment groups to an unconnected endpoint of another of the line segment groups being the closest unconnected endpoint to the unconnected endpoint of the one of the line segment groups.

11. A computer-readable medium storing an embroidery data generating program, the program comprising instructions that cause a computer to perform the steps of:

generating a plurality of line segment data pieces based on image data being an aggregation of pixels, each of the line segment data pieces including an angle component;

calculating a distance from an ending endpoint of one of a plurality of line segments to an endpoint of another of the plurality of line segments, the plurality of line segments being respectively specified by the plurality of line segment data pieces;

calculating an angle formed by the one of the plurality of line segments and the other of the plurality of line segments;

determining, based on a result of a distance calculation and a result of an angle calculation, which of endpoints of the plurality of line segments is a connecting endpoint to be connected to the ending endpoint;

connecting the plurality of line segments by connecting the ending endpoint and the connecting endpoint; and generating embroidery data for forming stitches following the plurality of line segments that have been connected.

12. The computer-readable medium according to claim 11, wherein a line segment is found that has an endpoint for which the calculated distance is within a first specified range and for which the calculated angle is within a second specified range, and the endpoint of the found line segment that is within the first specified range is determined to be the connecting endpoint.

13. The computer-readable medium according to claim 12, wherein the step of connecting the plurality of line segments includes the steps of:

generating a line segment group including at least two of the plurality of line segments by sequentially connecting the ending endpoint and the connecting endpoint; and connecting, in a case where a plurality of line segment groups are generated, the plurality of line segment groups by connecting an unconnected endpoint of one of the plurality of line segment groups to an unconnected endpoint of another of the plurality of the line segment groups being the closest unconnected endpoint to the unconnected endpoint of the one of the line segment groups.

14. The computer-readable medium according to claim 12, wherein the angle is calculated in a case where the calculated distance is within the first specified range, and the connecting endpoint is determined to be an endpoint for which the distance from the ending endpoint is the shortest among the endpoints of the line segments for which the angle has been calculated.

15. The computer-readable medium according to claim 12, wherein the angle is calculated in a case where the calculated distance is within the first specified range, and the connecting endpoint is determined to be an endpoint of a line segment for which the angle is the smallest among the line segments for which the angle has been calculated.

16. The computer-readable medium according to claim 11, wherein the program further comprises instructions that cause the computer to perform the steps of:

generating, based on color information in the image data, a plurality of divided areas into which an entire area of an image specified by the image data is divided; and allocating each of the plurality of line segment data pieces to one of the plurality of divided areas, corresponding to a position, within the image, of a line segment specified by each of the plurality of line segment data pieces, and the distance from the ending endpoint of the one of the plurality of line segments to the endpoint of the other of the plurality of line segments is calculated, a line segment data piece specifying the one of the plurality of line segments and a line segment data piece specifying the other of the line segments being allocated to the same divided area.

17. The computer-readable medium according to claim 16, wherein a line segment is found that has an endpoint for which the calculated distance is within a first specified range and for which the calculated angle is within a second specified range, and the endpoint of the found line segment that is within the first specified range is determined to be the connecting endpoint.

18. The computer-readable medium according to claim 17, wherein the step of connecting the plurality of line segments includes the steps of:

generating, for each of the plurality of divided areas, a line segment group including at least two of the plurality of line segments by sequentially connecting the ending endpoint and the connecting endpoint;

generating, for each of the plurality of divided areas, in a case where a plurality of line segment groups are generated, an intra-area line segment group including at least two of the plurality of line segment groups by connecting an unconnected endpoint of one of the plurality of the line segment groups to an unconnected endpoint of another of the plurality of line segment groups being the closest unconnected endpoint to the unconnected endpoint of the one of the plurality of the line segment groups; and connecting the intra-area line segment groups, across all of the plurality of divided areas, by connecting an unconnected endpoint of one of the intra-area line segment groups to an unconnected endpoint of another of the intra-area line segment groups, the unconnected endpoint of the other of the intra-area line segment groups being the closest to the unconnected endpoint of the one of the intra-area line segment groups.

19. The computer-readable medium according to claim 18, wherein the program further comprises instructions that cause the computer to perform the steps of:

determining a color of each of the plurality of line segment groups generated in the step of generating the line segment group, based on the image data; and setting a thread color of an embroidery thread to be used to form stitches following each of the plurality of line segment groups, based on the color of each of the plurality of line segment groups, the intra-area line segment group is generated for line segment groups of which the set thread color is the same, and the intra-area line segment groups are connected of which the set thread color is the same.

20. The computer-readable medium according to claim 16, wherein the step of connecting the plurality of line segments includes the steps of:

generating, for each of the plurality of divided areas, a line segment group including at least two of the plurality of line segments by sequentially connecting the ending endpoint and the connecting endpoint;

determining a color of each of the line segment groups, based on the image data;

setting a thread color of an embroidery thread to be used to form stitches following each of the line segment groups, based on the color of each of the line segment groups; and connecting, across all of the plurality of divided areas, the line segment groups of which the set thread color is the same by connecting an unconnected endpoint of one of the line segment groups to an unconnected endpoint of another of the line segment groups being the closest unconnected endpoint to the unconnected endpoint of the ones of the line segment groups.

* * * * *